US006709727B1

(12) United States Patent
Parker

(10) Patent No.: US 6,709,727 B1
(45) Date of Patent: Mar. 23, 2004

(54) BOOKBINDING STRUCTURE AND METHOD

(75) Inventor: Kevin P. Parker, Berkeley, CA (US)

(73) Assignee: Powis Parker Inc., Berkeley, CA (US)

( * ) Notice: Subject to any disclaimer, the term of this patent is extended or adjusted under 35 U.S.C. 154(b) by 56 days.

(21) Appl. No.: 09/684,582

(22) Filed: Oct. 6, 2000

(51) Int. Cl.[7] ..... B42C 9/00

(52) U.S. Cl. ..... 428/40.1; 412/3; 412/4; 412/5; 412/8; 412/900; 412/901; 412/902; 462/57; 462/72; 428/41.8; 428/41.9; 428/42.1; 428/192; 428/194; 493/374; 493/379; 493/382

(58) Field of Search ..... 428/40.1, 41.8, 428/41.9, 42.1, 192, 194, 346, 347, 350, 352, 354; 281/21.1; 462/57, 72; 412/3, 4, 5, 8, 900, 901, 902; 493/379, 382, 374

(56) References Cited

U.S. PATENT DOCUMENTS

| | | | | |
|---|---|---|---|---|
| 2,294,347 | A | 8/1942 | Bauer | 428/40.1 |
| 3,816,866 | A | 6/1974 | Miaskoff et al. | 11/3 |
| 3,847,718 | A | 11/1974 | Watson | 281/21 |
| RE29,105 | E | 1/1977 | Miaskoff et al. | 11/3 |
| 4,299,410 | A | 11/1981 | Jukola | 281/21 R |
| 4,377,430 | A | 3/1983 | Bexley et al. | 156/184 |
| 4,420,282 | A | 12/1983 | Axelrod | 281/28 |
| 4,496,617 | A | 1/1985 | Parker | 428/55 |
| 5,078,563 | A | 1/1992 | Lolli | 412/8 |
| 5,154,447 | A | 10/1992 | Tooker | 281/21.1 |
| 5,364,215 | A | 11/1994 | Snellman et al. | 412/3 |
| 5,779,423 | A | 7/1998 | Bermingham | 412/4 |
| 6,322,867 | B1 | 11/2001 | Rush et al. | 428/40.1 |

FOREIGN PATENT DOCUMENTS

| | | | |
|---|---|---|---|
| JP | 3-227698 | * 10/1991 | |
| JP | 403227698 A | 10/1991 | 312/184 |

OTHER PUBLICATIONS

Seal and View®"Clear Label Products" Self Adhesive Stock NO. CLL manufactured by Smead, Hastings Minneasota. Admitted Prior Art.

* cited by examiner

*Primary Examiner*—Nasser Ahmad
(74) *Attorney, Agent, or Firm*—Girard & Equitz LLP

(57) ABSTRACT

A bookbinding structure for binding a stack of sheets including an elongated substrate having a first surface on which a first, heat activated, adhesive matrix is disposed and a second surface on which a second, pressure activated adhesive is disposed. The first adhesive matrix will be used to binding an edge of the stack so as to form a bound book with no cover. The second adhesive matrix includes first and second spaced-apart segments which extend along the length of the substrate. First and second release liners are disposed over the first and second adhesive segments, with the release liners remaining in place until the stack of sheets have been bound with the bookbinding structure. One of the release liners is manually removed from the bound stack and the stack is positioned in a cover assembly with the edge of the stack being positioned opposite a spine section of the cover assembly. The remaining release liner prevents the cover assembly from prematurely attaching to the stack thereby enabling the user to more easily positioned the stack with in the assembly. The user then forces the cover assembly against the exposed adhesive segment thereby securing part of the cover assembly to the stack. The second release liner is then removed and pressure is applied to that part of the cover assembly opposite the exposed segment thereby completing the binding sequence.

25 Claims, 20 Drawing Sheets

BOOKBINDING STRUCTURE AND METHOD

BACKGROUND OF THE INVENTION

1. Field of the Invention

The present invention relates rally to the field of bookbinding, and more particularly, to a bookbinding structure and method that may be used with a wrap-around book cover.

2. Description of Related Art

Bookbinding systems utilizing binder strips are well known. Binder strips are used to bind pages together to form a book in which the binder strip forms the spine of the book. Binder strips which use a heat activated adhesives of low and high viscosity are used to bind a stack of sheets using heat and pressure which are applied to the strip and stack using a special purpose binding machine.

U.S. Pat. No. 4,496,617, the contents of which are hereby fully incorporated herein by reference, describes such a binding strip. The strips include an elongated paper substrate and an adhesive matrix disposed on the substrate. The matrix includes a central adhesive band which is heat activated and which has a relatively low viscosity when activated and a pair of outer adhesive bands. The outer bands are also heat activated, but are of a relatively high viscosity. The central adhesive band functions to secure the edges of the pages to be bound together and to the substrate and the outer bands function to secure the front and back cover pages to the substrate.

Such prior art binder strips are, however, not suitable for some applications due to the appearance of books bound by such strips. The spines of books bound by the conventional binder strips are often devoid of any printed information because the binder strips require specialized equipment for printing on the strip. Moreover, it is sometimes desirable to have a uniform cover having a continuous design from the front cover to the back cover, frequently including the spine. A conventional binder strip cannot provide a bound book having a cover with such a continuous design.

One approach to address the shortcomings of the above-described prior art involves the use of a binder strip having a second adhesive layer which permits the cover to be applied after the binding sequence. As will be explained, this approach permits a printed cover to be applied after the binding sequence so that the cover can be preprinted with heat sensitive inks.

Referring to the drawings, FIG. 1A shows one embodiment of a prior art binder strip which permits a cover to be added after the binding sequence is completed. FIG. 1A is an exploded perspective view of the various layers of a first embodiment of the prior art bookbinding structure 1. In the first embodiment, the bookbinding structure 1 includes an elongated substrate 6 having a length which corresponds to the length of the stack of pages (not depicted) to be bound and a width which exceeds the thickness of the stack by at least a minimum amount so that the edges of the substrate 6 will extend around the edge of the stack and slightly over the front and back pages of the stack, as will be described. Substrate 6 is preferably made of a formable material such as heavy weight paper.

A layer of pressure activated adhesive 3 is disposed on one surface of the substrate 6, with a heat activated adhesive matrix 4 being disposed facing the opposite substrate surface. The pressure activated adhesive 3 is typically a permanently binding adhesive which, once activated by applying pressure, produces a relatively permanent bond. One such pressure activated adhesive is sold under the designation HL-2593 by H. B. Fuller Company of St. Paul, Minn. The Fuller HL-2593 pressure activated adhesive can be subjected briefly to high temperatures, up to about 425 degrees F, without decomposing. The ability of the pressure activated adhesive 3 to withstand high temperatures is important because the bookbinding structure 1 is subjected briefly to high temperatures during the binding process, which will be described in more detail below. The pressure activated adhesive is preferably 0.003 to 0.005 inches thick.

The pressure activated adhesive 3 is covered with a removable release liner 5, as shown in FIG. 1A, to act as a barrier between the pressure activated adhesive 3 and the environment. The release liner 5 is preferably a silicon coated paper, such as made by Akrosil, Inc. of Menasha, Wis. under the designation Silox ® SBL60SC F1U/F4B. The surfaces of the coated paper can have varying release levels, with a low or easy release level indicating that the paper can be separated with little force and a high or tight release level indicating the separation requires a relatively large amount of force. The designation F4B indicates that the release level of the liner surface contacting the pressure sensitive adhesive layer 3 has a medium release level, with the opposite surface of the liner having a low or easy release level as indicated by the designation F1U.

The heat activated adhesive matrix 4 is comprised of a center adhesive 4A which extends along the longitudinal axis of the substrate 6 and a pair of outer adhesive bands 4B. The center adhesive band 4A, which is a heat activated adhesive of relatively low viscosity, is the primary adhesive for binding the pages together. The center adhesive 4A is typically 0.015 inch thick. An adhesive, sold under the designation Cool Bind 34-1301 by National Starch & Chemical Company of Bridgewater, N.J., has been found to be suitable as the center adhesive band 4A. The center adhesive band 4A preferably extends over slightly less than the full length of the bookbinding structure 1 so that there are end gaps without the center adhesive 4A. In addition, the center adhesive band is at least as wide as the thickness of the stack 13 to be bound so that all of the pages of the stack will be exposed to the low viscosity adhesive.

The outer adhesive bands 4B are comprised of a heat activated adhesive of relatively high viscosity when activated and possesses a high degree of tackiness. The outer adhesive bands 4B function to attach the substrate 6 to the front and back pages of the stack. The outer adhesive bands 4B preferably extend along the entire length of substrate 6 and are 0.010 inch thick. An adhesive sold under the designation HB HL-1777 by H. B. Fuller Company of St. Paul, Minn., may be used for the outer adhesive bands 4B.

The FIG. 1A bookbinding structure further includes an undercoat adhesive layer 7 disposed intermediate the adhesive matrix 4 and the substrate 6. The undercoat adhesive is heat activated and is relatively thin, typically 0.003 inches thick. The undercoat is preferably the same type of adhesive used in the outer adhesive bands 14B and functions to act as a barrier so as to prevent the low viscosity central adhesive band 4A from passing through the substrate 6. In addition, the undercoat adhesive prevents all of the low viscosity adhesive of central band 4A from being drawn up between the pages of the stack which may leave essentially no adhesive intermediate the edges of the pages and the substrate 6.

The manner in which the FIG. 1A prior art bookbinding structure 1 is applied to the stack 13 and used to bind the stack will be subsequently described. However, once the stack of pages has been bound, the structure 1 and stack 13 appear as shown in FIG. 4. As can be seen, the structure 1 is positioned on the bound edge of stack 13. Note that the bound stack 13 does not include a cover at this stage of the sequence, with top of the stack being the first page and the bottom of the stack being the last page. The pressure sensitive adhesive 3 is exposed by manually removing the release liner 5 as shown in the drawing. A cover assembly or book cover 2 is positioned on a flat surface as shown in FIG. 5. The bound book 13 is then carefully positioned above the cover 2 so that the stack is aligned with the right hand portion of the cover, with the bound edge of the stack being positioned near the center of the cover.

After alignment, the stack 13 is lowered on to the book cover 2 so that the bottom portion of the exposed adhesive contacts the cover. The adhesive 3 is very aggressive in order to secure the cover assembly 2 adequately.

Unfortunately, if the cover assembly 2 is not properly aligned, it is generally not possible to separate the stack 13 from the cover since the adhesive bond is permanent. Accordingly, it is important that the alignment be correct in the first instance. It has been found that an "L" shaped ruler, referred to as a carpenter's square, can be placed on the work surface and used to carry out the alignment. An apparatus to assist in aligning the stack 13 and cover assembly 13 together is disclosed in U.S. application Ser. No. 60/204,220 filed on May 15,00 and entitled "Apparatus and Method of Binding Soft Cover Book", the contents of which are hereby fully incorporated by reference into the present application.

As shown in FIG. 6, once the stack 13 has been properly positioned on the cover assembly 2, the assembly is manually folded around the edge of the bound stack. Pressure is applied to the outer surface of the cover assembly 2 in the spine region to ensure that the cover assembly is secured in all areas where the pressure sensitive adhesive is present. This results in a bound book 14 having a cover assembly 2 forming the front and rear book cover together with the book spine.

FIG. 7 is a cross-sectional end view of the bound book using the first embodiment prior art bookbinding structure 1 which is not shown to scale so that all of the various layers can be seen. Preferably, the cover assembly 2 is pre-scored at the two locations so that the cover assembly can easily be folded at the proper locations. The cover assembly 2 can be previously printed using any type of process, including printing processes that utilize heat sensitive inks since the cover assembly is never subjected to elevated temperatures when using the first embodiment bookbinding structure 1.

Note that the cover assembly 2 need only cover that portion of the spine which includes the pressure sensitive adhesive 3. FIG. 9A shows a cross-section of a bound book where the cover assembly covers that front and rear pages of the book together with the spine, as previously described in connection with FIG. 7. FIG. 9B shows a bound book where the cover assembly 2 covers only the front page, a very small portion of the back page and the spine. Finally, FIG. 9C shows a bound book where the cover assembly 2 only covers the spine and a small portion of the front and back pages sufficient to cover the pressure sensitive adhesive.

The manner in which the first embodiment prior art bookbinding structure 1 is applied to the stack 13 so as to bind the stack will now be described. One significant advantage of the present invention is that an existing, commercially available binding machine can be used to carry out the binding sequence. One such machine is described in U.S. Pat. No. 5,052,873, the contents of which are hereby fully incorporated herein by reference. The binding sequence set forth in U.S. Pat. No. 5,052,873 uses a conventional binder strip of the type disclosed in previously noted U.S. Pat. No. 4,496,617.

FIG. 2 depicts a conventional binding machine 8 such as described in U.S. Pat. No. 5,052,873. Machine 8 has a stack 13 to be bound inserted into the machine input. The thickness of the stack is automatically measured and the appropriate width binding structure I is displayed. As is the case with conventional binder strips, the binding structure 1 is preferably available in three widths to accommodate stacks 13 of varying width. Such widths include "Narrow", "Medium" and "Wide", with the width of the central adhesive band 4A being altered for each binder structure 1 width. Machine 8 will specify a structure 1 width having a central adhesive 4A width that is at least as wide as the measured thickness of the stack 13. A binding structure 1 of the appropriate width is then manually fed into the strip feed input of the machine 8. The machine then automatically carries out the binding sequence by appropriately positioning the structure 1 relative to the edge of the stack 13 and applying a combination of heat and pressure as will be described.

The binding sequence is depicted schematically in FIGS. 3A through 3F. End views are shown of the stack 13 and the binding structure 1. Referring to FIG. 3A, the stack 13 to be bound, after loading, is gripped between a pair of clamps 10 and 11 and is initially supported on a cool platen 9. A strip positioning apparatus (not depicted) positions the binding structure 1 previously fed into the machine so that the adhesive matrix 4 is facing the stack 13. The vertical position of the structure 1 relative to the stack 13 is automatically set in accordance with the thickness of the stack as previously measured. A thin stack 13 will result in the structure 1 being positioned relatively high so that the edges of the structure 1 will extend equally over the front and rear pages of the bound stack. Similarly, a thick stack will result in the structure 1 being positioned somewhat lower. A heated platen having a rotating segment 12A and a non-rotating segment 12B is positioned facing the binding structure 1. The platen segments 12A and 12B are at least as long as the length of the stack and the length of the elongated binding structure 1.

As shown in FIG. 3B, the stack 13 is moved laterally away from the cold platen 9 towards the rotating platen segment 12A. This movement is carried out by way of clamps 10 and 11 which support and move the stack. The lower portion of the stack 13 is forced against the heated rotating platen portion 12A, with one edge of the binding structure I being disposed between the platen portion 12A and the stack 13. Note that the binding machine element which supports the opposite side of stack 13 at this point in the sequence is not depicted in the drawings. The resultant heat and pressure applied to one edge of the bookbinding structure 1 results in activation of one of the outer adhesive bands 14B (FIG. 1A). This will cause an adhesive bond or seal to be formed between the structure 1 and the front page of stack 13. Since the outer adhesive bands 14B are high tack when activated, the binding structure 1 remains bonded to the front page of the stack 13 when the stack is moved away from the heated rotating platen portion 12A as shown in FIG. 3C.

As shown in FIG. 3D, the rotating platen segment 12A is rotated 90 degrees so that both the rotating and fixed platen segments 12A and 12B define a flat upper surface. This permits stack 13 to be moved to the right over the platen segments. This causes the bookbinding structure 1 to be folded around the lower edge of the stack 13. The binding machine 8 pauses briefly in this position so that the central adhesive band 4A will have time to become molten and to flow upward by way of capillary action between the individual pages of the stack 13 thereby fulling wetting the pages with the adhesive. The rotating platen segment 12A is then rotated 90 degrees back to the original position as shown in FIG. 3E. This results in the remaining edge of the bookbinding structure 1 to be folded around the edge of the stack 13, with the remaining outer adhesive band 4B being positioned facing the rear page of the stack 13. The stack 13 is then forced against the rotating platen portion 12A thereby activating the outer adhesive band 4B so as to form the final adhesive bond. The bound stack 13 is then removed from the binding machine and permitted to cool for a few minutes so that the adhesives have an opportunity to set. The cover assembly 2 is then secured to the stack as previously described in connection with FIGS. 4, 5 and 6.

Note that the first embodiment bookbinding structure 1 could also be implemented without substrate 6. In that event, undercoat adhesive layer 7 is disposed directly on the pressure activated adhesive layer 3. The release liner 5 then provides the additional function of acting as a substrate and supporting the structure 1 during the binding sequence previously described in connection with FIGS. 3A through 3E.

A second embodiment of the prior art bookbinding structure is depicted in FIG. 1B. The second embodiment bookbinding structure 1 includes an adhesive matrix 4 similar to that of the first embodiment structure of FIG. 1A. A substrate 6 is provided having the same shape as that of the first embodiment, with there being an undercoat adhesive layer 7 similar to layer 7 of FIG. 1A. The second embodiment structure 1 does not include, among other things, the pressure activated adhesive 3 of the first embodiment.

A stack 13 is bound using the second embodiment structure 1 in the same manner as that of the first embodiment structure. Once the steps of FIGS. 3A through 3E are carried out using the conventional binding machine 8, the bound stack is permitted to cool. The substrate 6 is then manually removed from the stack in much the same manner as the release liner 5 is removed from the stack as depicted in FIG. 4. Thus, the substrate 6 of the second embodiment also functions as a release liner.

Removal of substrate 6 exposes the undercoat adhesive layer 7. Adhesive layer 7 together with the remaining adhesive of the adhesive matrix 4 is then used to attach a cover assembly 2 to the bound stack 13. Since the adhesives are heat activated, it is necessary to reheat the adhesives so that they can be used for this purpose. It is possible to again use a conventional binding machine 8 to carry out the sequence for attaching the cover assembly 2 to the bound stack 13, as will be described.

The cover assembly 2 of appropriate dimensions is first placed on a flat surface and the bound stack 13 is positioned over the assembly in much the same manner as previously described in connection with the first embodiment. The cover assembly 2 is folded around the stack 13 to the desired final position. Preferably, the assembly is pre-scored to facilitate this step. Since the adhesives are not activated at this point, proper positioning is somewhat easier to accomplish as compared to the first embodiment. The cover assembly/stack combination 2,13 is then inserted into the conventional binding machine 8, taking care to hold the cover assembly 2 in place until the combination is gripped by the machine clamps 10 and 11 (FIG. 3A). The binding machine 8 must be slightly modified to carry out the cover assembly 2 attachment sequence since the machine normally requires activation when a binder strip is manually fed into the machine as shown in FIG. 2. Such modification would simply simulate the detection of a binder strip being fed into the machine. Alternatively, it is possible to activate the machine 8 by momentarily inserting a binder strip into the machine so as to initiate the sequence and to then rapidly withdraw the strip from the machine since the strip is not needed and should not be present.

FIG. 8A shows a book 14, which includes the bound stack 13 and the folded cover assembly 2, installed in the binding machine 8 and resting on the cool platen 9 (not depicted). Book 14 is secured by opposing clamps 10 and 11 (not depicted). This point in the binding machine sequence corresponds to that shown in FIG. 3A where the binding structure 1 is being applied to the stack 13. Note that FIG. 8A does not include a binding structure as does FIG. 3A since the structure was previously applied. The stack 13 is then forced against heated platen segment 12A so that one of the outer adhesive bands 4B is activated and compressed between the cover assembly 2 and the front page of the stack 13 as shown in FIG. 8B. This corresponds to FIG. 3B of the binding machine 8 sequence. Thus, a first adhesive seal in created between the stack 13 and the cover assembly 2.

The stack 13 with cover 2 is then moved away from the heated platen segments 12A and 12B as indicated in FIG. 8C and the rotating platen segment is rotated 90 degrees as shown in FIG. 8D. The stack 13 is then positioned over the heated platen sections 12A and 12B so that a seal will be formed between the edge of the stack 13 and that part of the cover 2 which forms the spine. FIGS. 8C and 8D correspond generally to FIGS. 3C and 3D, respectively.

The rotating platen segment 12A is then rotated back 90 degrees, with the stack 13 and platen segment 12A then being forced together as shown in FIG. 8E which corresponds to FIG. 3E. The resultant application of heat and pressure will cause a further adhesive seal to be formed between the cover 2 and the last page of the stack 13. This will complete the binding sequence so that the bound book can be removed from the binding machine and permitted to cool.

Since the cover assembly 2 is heated when the second embodiment bookbinding structure 1 is used, any printing on the cover assembly should be carried out using inks not sensitive to heat. Further, substrate 6 must be made of a material that will support the various molten adhesives applied to the substrate when the bookbinding structure is fabricated and will provide sufficient support during the binding sequence of FIGS. 3A through 3E so that the structure 1 can be manipulated and heated by the binding machine 8 in order to carry out the sequence. Still further, the substrate 6 must be made of a material that has a sufficiently high release value to permit the substrate to be manually separated from the bound book 13. It has been found that the substrate material of the second embodiment should not contain free silicon since this material has been found to contaminate the adhesives and destroy the adhesive properties. Thus, the material must be either fully reacted silicon based or be non-silicon based. The substrate could be fabricated from a liner material having a repositionable adhesive such as a product sold under the designation ReMount 6091 by the Industrial Tape and Specialties Division of 3M located in St Paul, Minn.

FIG. 1C is an exploded view of a third embodiment prior art bookbinding structure. The third embodiment is similar to the first embodiment (FIG. 1A) except that a solvent activated adhesive 15 is used instead of a pressure activated adhesive 3. This feature eliminates the requirement for a release liner, such as liner 5 of the first embodiment. The solvent activated adhesive 15 must be able to withstand temperatures up to about 425F which are created during the binding sequence as depicted in FIGS. 3A through 3E. One suitable solvent activated adhesive is an adhesive sold under the designation Weldbond by Frank T. Ross and Sons, Inc. in Spring Grove, Ill. The Weldbond adhesive may be activated by either water or alcohol.

The manner in which the stack 13 is bound using the third embodiment bookbinding structure 1 is the same as the first embodiment except that the exposed adhesive 15 must be activated by application of water or alcohol prior to placement of the bound stack 13 on the cover assembly 2. Since the cover assembly 2 is never subjected to elevated temperatures, it is possible to print the cover assembly 2 using printing techniques that require heat sensitive inks.

As previously noted, it can be difficult to reliably position the bound stack 13 on the cover assembly 2 as shown in FIG. 5. If the alignment is not correct in the first instance, it is not possible to remove the cover assembly 2 without damage to the cover assembly 2. Although the apparatus noted above and disclosed in U.S. application Ser. No. 60/204,220 is very useful in assisting in such alignment, such apparatus will not always be available to many users, particularly users binding a small number of books. In addition, when a stack 13 is bound as shown in FIG. 7, the spine section of the cover assembly is secured to the end of the stack 13 the full width of the stack. Thus, when the bound book is opened, the spine section of the cover assembly 2 is compressed and deformed. Once the book is opened and closed several times by a reader, the compression and deformation tend to damage any printing on the spine thereby detracting from the appearance of the book. This compression and deformation also tends to prevent the book from lying flat on a surface when the book is opened.

The present invention addresses the above-noted shortcomings of the prior art bookbinding structure. A user is able to accurately align the stack and cover assembly in the first instance. This is easily accomplished without the need of any special alignment apparatus. Further, in one embodiment of the present invention, the spine section of the cover can separate from the spine of the bound book so that compression and deformation of the spine section is reduced. This will significantly reduce any damage to the printed matter on the spine. Further, the appearance of the bound book will more accurately simulate that of a book bound using prior art mass production techniques. These and other advantages of the present invention will become apparent to those skilled in the art upon a reading of the following Detailed Description of the Invention.

SUMMARY OF THE INVENTION

A bookbinding structure for binding a stack of sheets, with the stack of sheets having a thickness, a width and a length. The structure includes an elongated substrate having a length that corresponds to the length of the substrate and a width somewhat greater than the thickness of the stack. A first adhesive matrix is disposed on what will be the inner surface of the substrate. Typically, the first adhesive matrix is heat activated and operates to bind the individual sheets together and to the substrate. Preferably, this part of the binding sequence is carried out using a conventional desk top binding machine.

A second pressure activated adhesive matrix is disposed on what will be the outer surface of the substrate. The second adhesive matrix functions to secure a cover assembly, which includes front and back cover sections and a spine section intermediate the front and back cover sections, to the bound stack. The cover apparatus can be preprinted prior to being applied to the bound stack. Heat sensitive inks can be used for printing since the binding sequence, which uses heat to activate the first adhesive matrix, takes place prior to attaching the cover apparatus to the bound stack.

The second pressure activated adhesive matrix includes a first segment that extends substantially along the full length of the substrate and a second segment that extends substantially along the full length of the substrate. First and second separate release liners are disposed over the first and second segments of the pressure activated adhesive matrix, respectively. The liners prevent the underlying pressure activated adhesive from becoming adhered to anything until the cover apparatus is to be attached to the bound stack. The first release liner it typically first manually removed, typically be peeling the liner away from the bound stack, with the second liner remaining in place. The user then positions the bound stack between the front and back cover sections of the cover apparatus, with the bound edge of the stack being positioned adjacent the spine section. The presence of the second release liner allows the user to more easily manipulate stack and cover assembly so that optimum alignment is achieved without the pressure activated adhesive prematurely adhering to the cover apparatus. If this were to occur, it is very difficult to separate the cover apparatus and bound stack apart so that repositioning can be carried out. Once proper alignment has been achieved, the user presses the cover apparatus against the exposed adhesive there by securing the cover apparatus to the stack in one location. The user then removes the second release liner so that the cover apparatus is secured to the cover apparatus at additional locations on the cover apparatus. In one example, the cover apparatus is secured to the stack only at the front and rear cover sections so that the spine section of the cover apparatus is free to move with respect to the edge of stack. Thus, when the bound book is opened, the spine section of the cover assembly is free to move away from the folded spine so that the opened book will tend to lay flat and so the spine section will remain unfolded thereby reducing potential damage to any printed matter on the spine section.

BRIEF DESCRIPTION OF THE DRAWINGS

The invention will be better understood by reference to the attached figures in which.

DETAILED DESCRIPTION OF THE INVENTION

Figure 10:
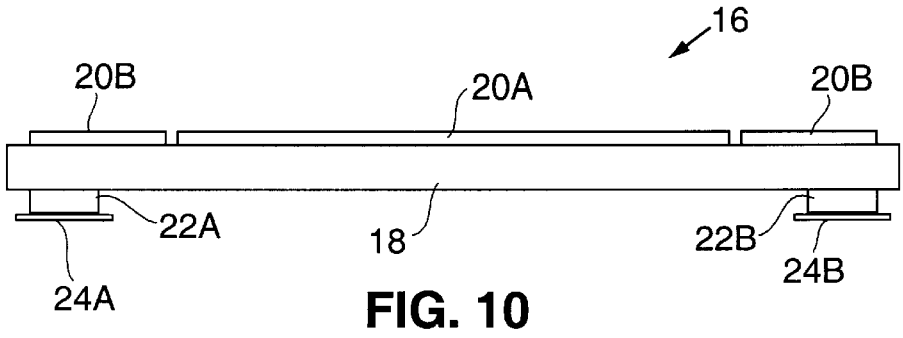
FIG. 10 is an end view of a first embodiment of a bookbinding structure in accordance with the present invention.
Figure 11:
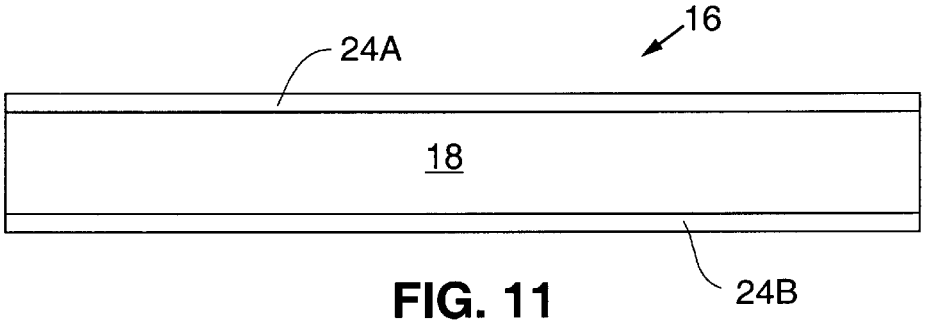
FIG. 11 is a bottom view of the first embodiment bookbinding structure showing the removable release liners.

Referring again to the drawings, FIGS. 10 and 11 are end and bottom views, respectively, of a bookbinding structure 16 in accordance with a first embodiment of the present invention. The bookbinding structure 16 includes an elongated substrate 18 similar to substrate 6 of the FIG. 1A prior art structure and which is somewhat wider than the thickness of stack of sheets to be bound and is the same length as that of the stacks. A central heat activated band 20A of adhesive is provided on what will be the inner surface of substrate 16 which is similar in composition, dimensions and function to the central band 4A of the FIG. 1A structure. Similarly, a pair of outer heat activated bands 20B of adhesive are disposed on the inner surface of substrate 16 which are similar in composition, dimensions and function to the outer bands 4B of the FIG. 1A structure. Although not shown in FIG. 10, a thin layer of undercoat adhesive can be used similar to undercoat adhesive 7 of the FIG. 1A structure.

The bookbinding structure 16 further includes a pair of outer adhesive bands 22A and 22B disposed on what will be the outer surface of substrate 18 and, which preferably extend the full length of the substrate along the outer edges of the substrate. Bands 22A and 22B are comprised of a pressure activated adhesive similar in composition to the pressure activated adhesive used in adhesive layer 3 of the prior art FIG. 1A structure. Adhesive band 22A is covered by an elongated release liner 24A which completely covers band 22A, as can be seen in FIG. 11. Similarly, adhesive layer 22B is covered a second release liner 24B similar in shape to liner 24A. Release liners 24A and 24B are preferably made of a silicon coated paper as previously described in connection with the release liner 5 of the FIG. 1A structure. As will be described in greater detail, adhesive bands 22A and 22B operate to secure a cover assembly to a stack of sheets bound by the binding structure 16.

Figure 1A:
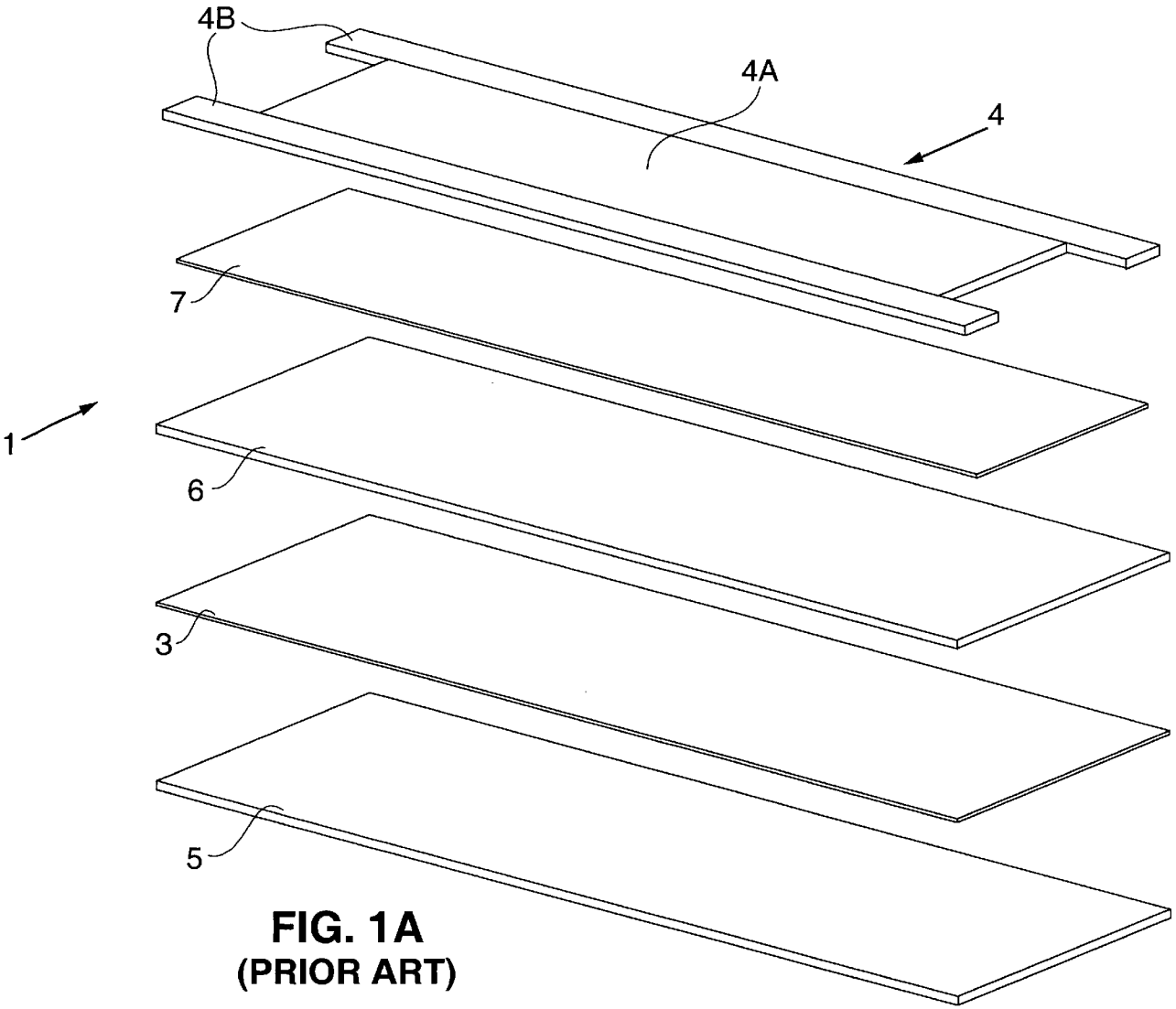
FIG. 1A (PRIOR ART)
FIG. 1A is an exploded view of the various layers of a first embodiment of a prior art bookbinding structure.
Figure 1B:
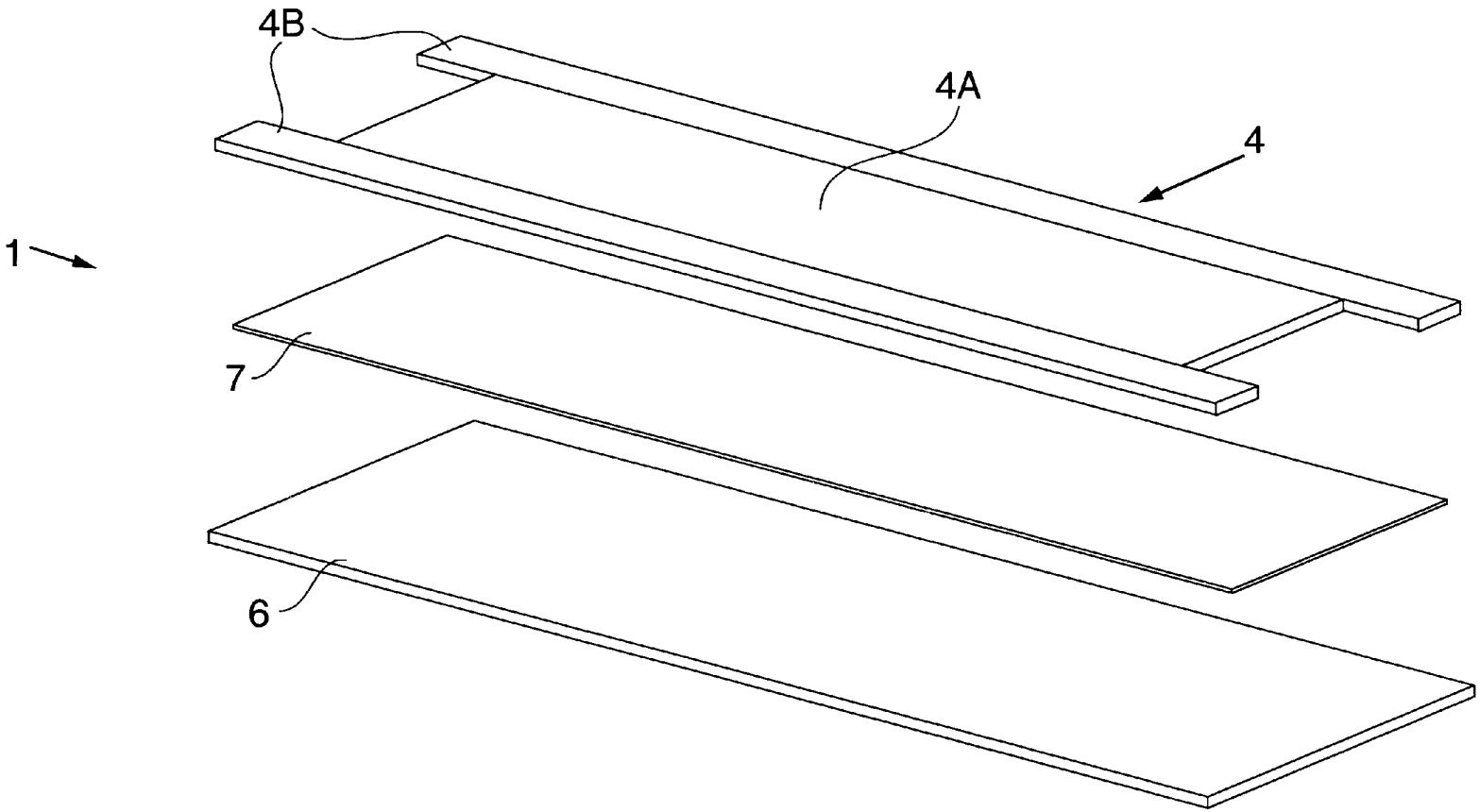
FIG. 1B (PRIOR ART)
FIG. 1B is an exploded view of a second embodiment of a prior art bookbinding structure.
Figure 1C:
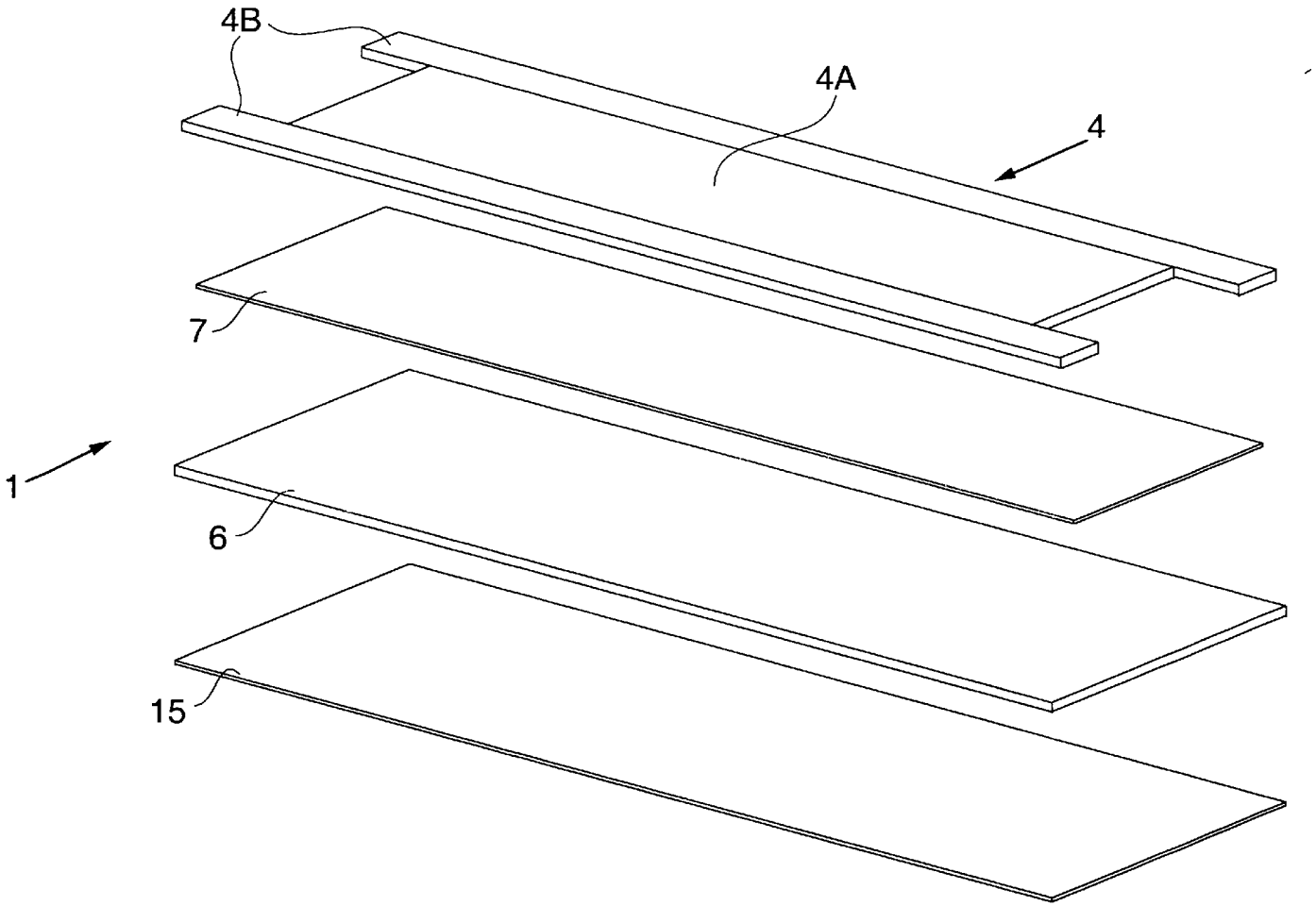
FIG. 1C (PRIOR ART)
FIG. 1C is an exploded view of a third embodiment of a prior art bookbinding structure.
Figure 12:
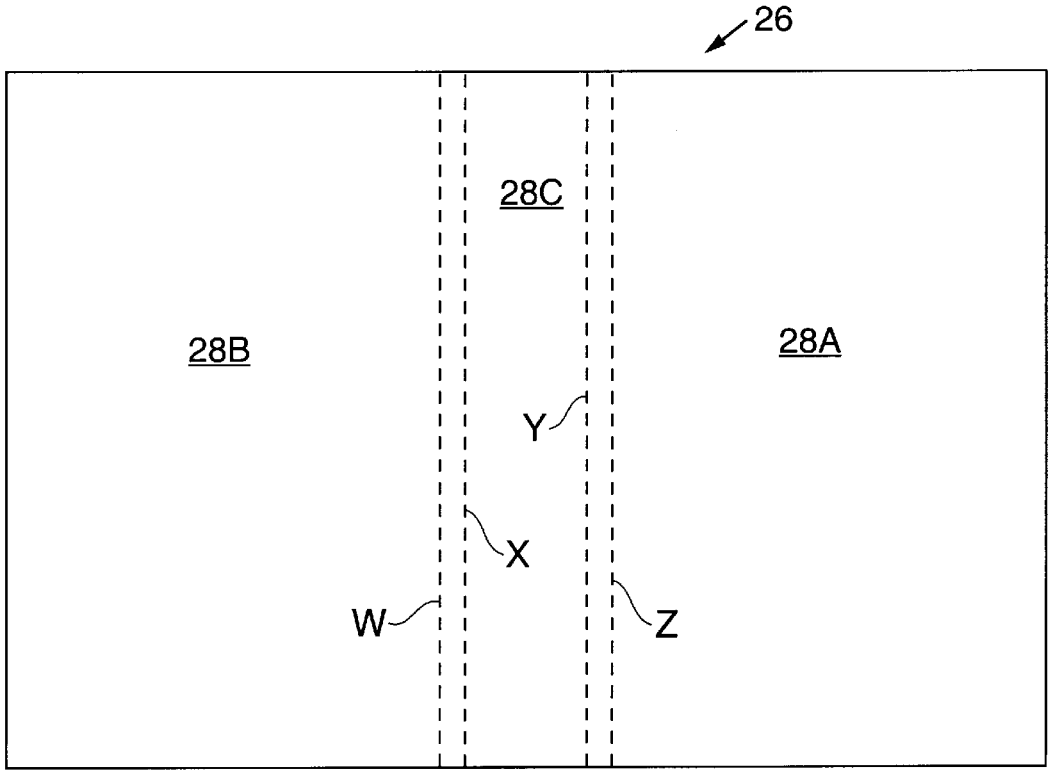
FIG. 12 is a plan view of a cover assembly suitable for use with the FIG. 10 bookbinding structure.

Typically, the bookbinding structures 16 are made in three widths, as in the case of the FIG. 1A structure, to accommodate stacks of varying thickness. However, in order to reduce the amount of binding products that needs to be maintained in stock, it would be possible to use a single relatively wide bookbinding structure 16 for a majority of stack thicknesses. In that case, it may be desirable to modify the binding machine, such as machine 8 shown FIG. 2, which is used to bind the stack, as will be described. A stack of sheets to be formed into a book are bound together in the same manner as previously described in connection with the prior art FIG. 1A embodiment and as illustrated in FIGS. 2 and 3A–3E. FIG. 12 shows one cover assembly 26, somewhat similar to cover assembly 2 previously described in connection with the FIG. 1A structure, that can be applied to the bound stack.

Cover assembly 26 includes a cover section 28A, a back section 28B and a spine section 28C. Preferably, four creases or scores W, X, Y and Z are formed in the cover assembly 26C as can be seen in FIG. 12. Creases X and Y are spaced apart a distance equal to the thickness of the stack to be bound, with W and X being spaced near that location of the cover assembly 26 where the assembly is secured by adhesive bands 22A and 22B, as will become more apparent. The apparatus and method described in previously noted U.S. application Ser. No. 60/204,220 can be used in accurately scoring the cover assembly in order to form the creases W, X, Y and Z, but this apparatus is not required. Typically, the cover assembly 26 is printed prior to the binding sequence. Since heat is not used to secure the cover assembly 26 to the stack, it is possible to use heat sensitive inks. In many cases, the cover assembly is slightly larger than required and is trimmed after the binding sequence is completed.

Figure 16A:
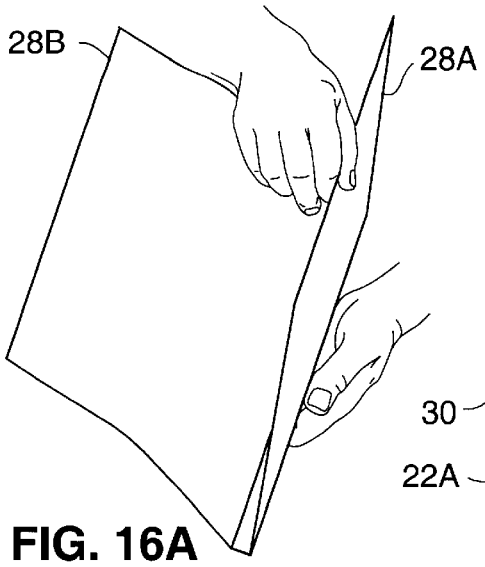
FIGS. 16A–16F further illustrate the manner in which the cover assembly is secured to a book bound with the FIG. 10 bookbinding structure.
Figure 16B:
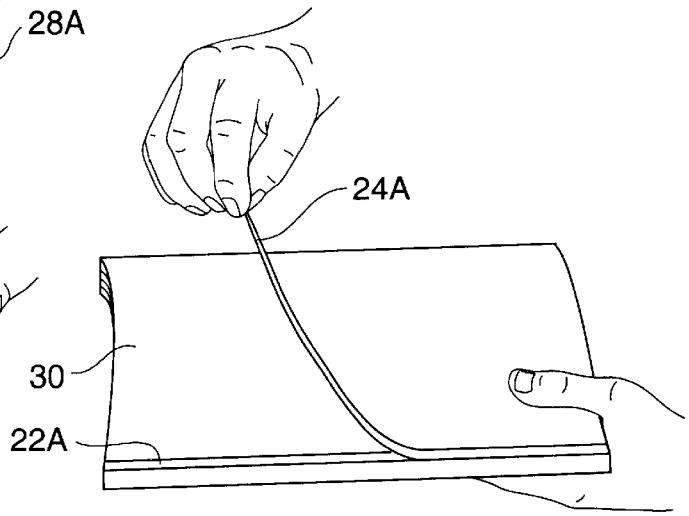
Figure 16C:
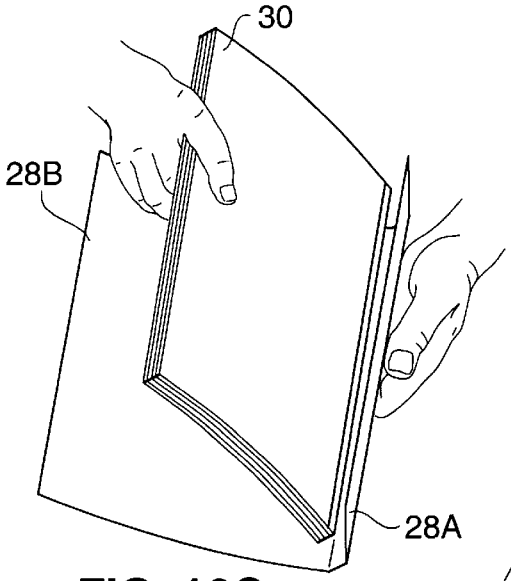

Once the stack has been bound using the bookbinding structure of FIG. 10, the cover assembly 26 is secured to the stack. As shown in the FIGS. 16A–16F, the final sequence of securing the cover assembly 26 to the stack 30 is performed manually. First, a user manually folds the pre-scored cover assembly along the score lines or creases X and Y as shown in FIG. 16A illustration. Next, the user manually removes (peels away) the release liner 24A from the binding structure 16 as shown in FIG. 16B. The user then positions the bound stack 30 inside the folded cover assembly 26. At this point, adhesive strip 22A is exposed, with strip 22B still being covered by release liner 24B. The user is able to easily position the bound stack 30 accurately between the front and rear cover sections 28A and 28B, that is, between the fold lines at scores X and Y as shown in FIG. 16C and in FIG. 13. Exposed adhesive band 22A will not adhere until the user actually presses the front cover section 28A against the band. Accordingly, the user is free to reposition the stack 30 and cover assembly 26 as may be required.

Figure 13:
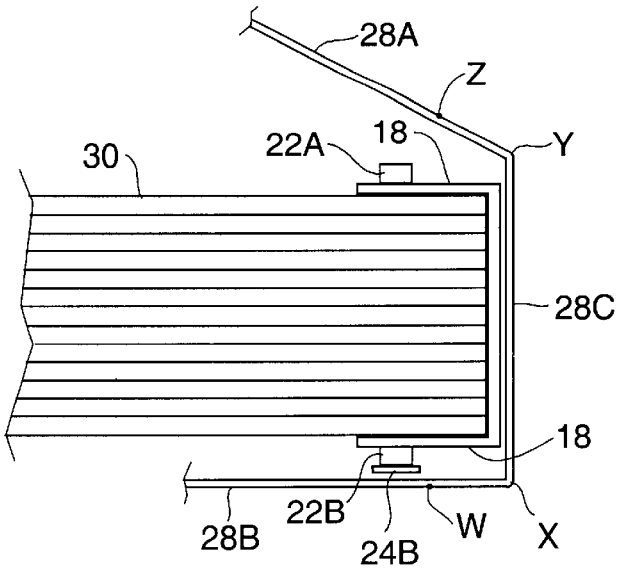
FIG. 13 is an elevational sectional view of the FIG. 10 bookbinding structure with one of the two release liners removed and showing the cover assembly being applied to one side of the bound book.
Figure 14:
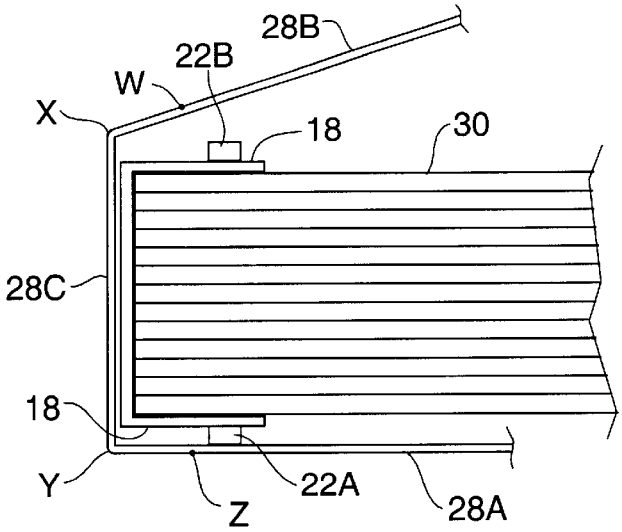
FIG. 14 is an elevational sectional view of the FIG. 10 bookbinding structure with the second one of the release liners removed and showing the cover assembly being applied to the other side of the bound book.
Figure 15:
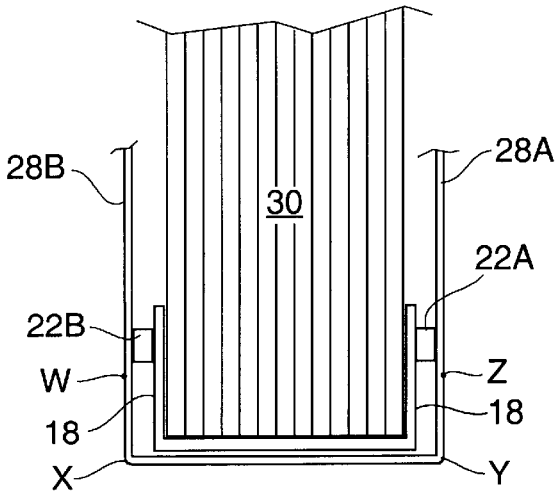
FIG. 15 is an elevational sectional view of the FIG. 10 bookbinding structure showing the bound book after both sides of the book having been secured to the cover assembly.
Figure 16D:
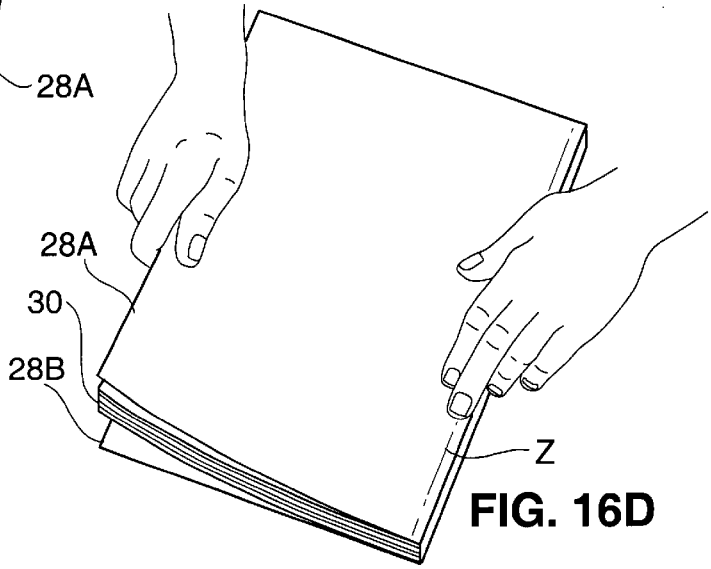
Figure 16E:
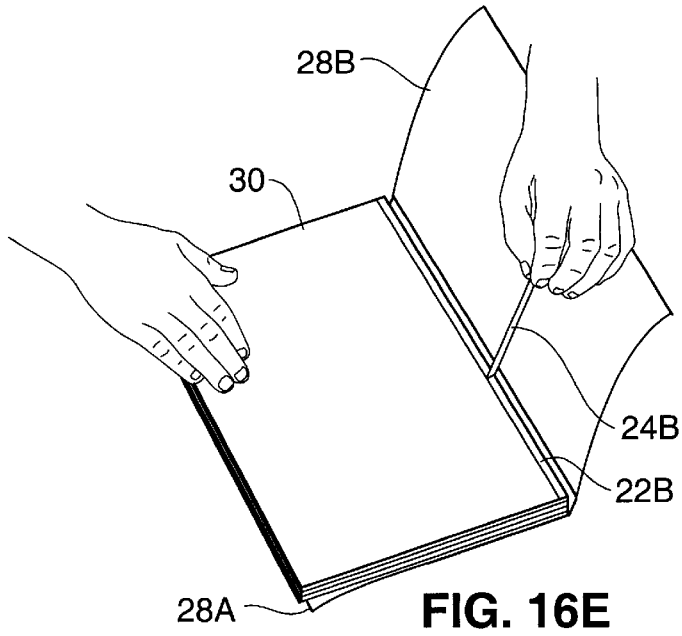
Figure 16F:
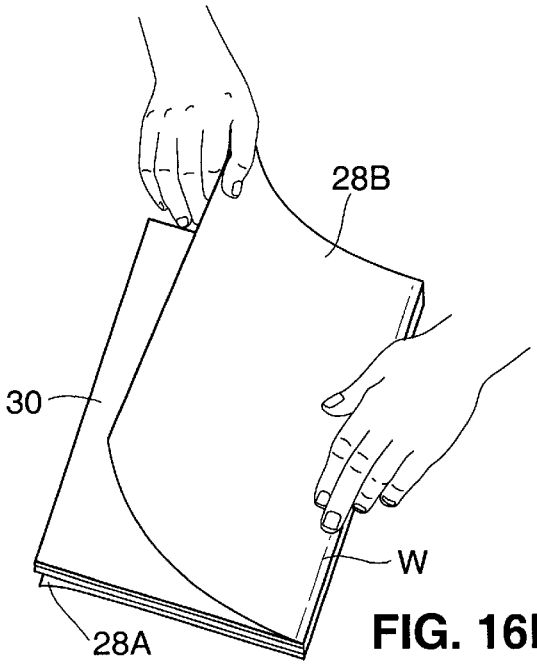

Once the user presses the cover section 28A against band 22A, as illustrated in FIG. 16D the cover assembly is securely attached to the bound book 30. Next, the user turns the entire assembly over and opens rear cover section 28B so as to expose the second release liner 24B. The second liner 24B is then removed as shown in FIG. 16E so as to expose pressure activated adhesive band 22B. The user then carefully wraps the cover assembly 26 around the spine of the stack 30 as shown in FIG. 14 and then presses the rear cover section 28B against the exposed adhesive band 22B as shown in FIG. 16F. This completes the bookbinding sequence, with score or crease line Z being located near the point at which the front cover section 28A is secured by adhesive 22A, intermediate that point and score or crease Y as shown in FIG. 15. Score or crease line W is located near the point at which the rear cover section 28B is secured by adhesive 28B intermediate that point and score or crease line X. Note that the illustrations of FIGS. 13, 14 and 15 are schematic in nature, with the dimensions being distorted in some cases to more clearly illustrate the invention.

Figure 17:
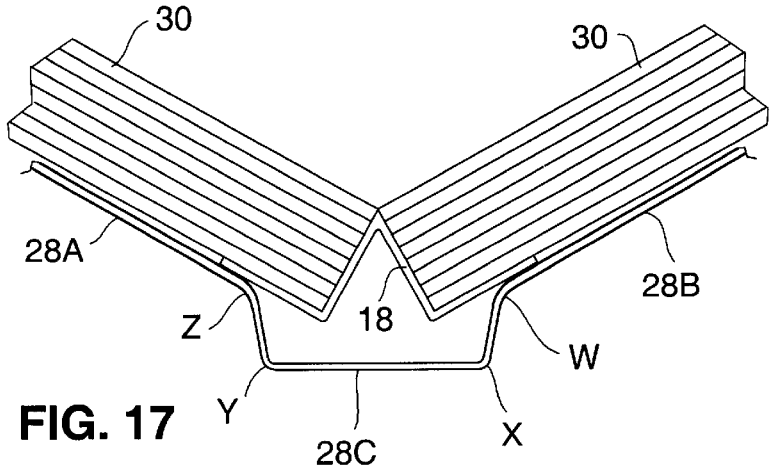
FIG. 17 is an elevational sectional view of a bound book using the FIG. 10 embodiment book binding structure illustrating the lay flat feature of that embodiment.

It can be seen that the first embodiment binding structure 16, having separately removable release liners 24A and 24B permits a bound stack 30 to be easily aligned and secured to the cover assembly 26. In addition, the first embodiment permits the bound book to be opened as shown in FIG. 17 so that the spine section 28C of the cover assembly is free to move away from the bound book. This is possible since the cover assembly is attached to the cover assembly at two spaced-apart locations along and adjacent to score lines W and Z. Thus, when the book is opened, the substrate 18 of the binding structure will remain secured to the edge of the stack and will fold when the stack is folded. The unattached spine section 28C will move away from substrate 18 as shown in FIG. 17, with this movement being facilitated by the presence of creases or score lines W, X, Y and Z. The spine section 28C will not be distorted when the book is opened so that any printing on the spine section will remain undisturbed. Further, the movement of the spine section prevents the spine section from resisting opening of the bound book, thereby allowing the bound book to lay open. This is sometimes referred to as a lay flat feature. In addition, this feature makes the book more closely simulate the appearance of conventional high-end paperback books bound using conventional mass production techniques thereby enhancing the appearance of the book. The width of the region on the outer surface of substrate 16 not covered by pressure activated adhesive should be somewhat wider than the thickness of the stack 30 to be bound, that is, slightly wider than the spacing between score lines X and Y. Since the actual width of the stack is not always know prior to the manufacture of the bookbinding structure, at least one half of the center width of outer surface of the substrate 18 is free of the pressure activated adhesive.

Figure 2:
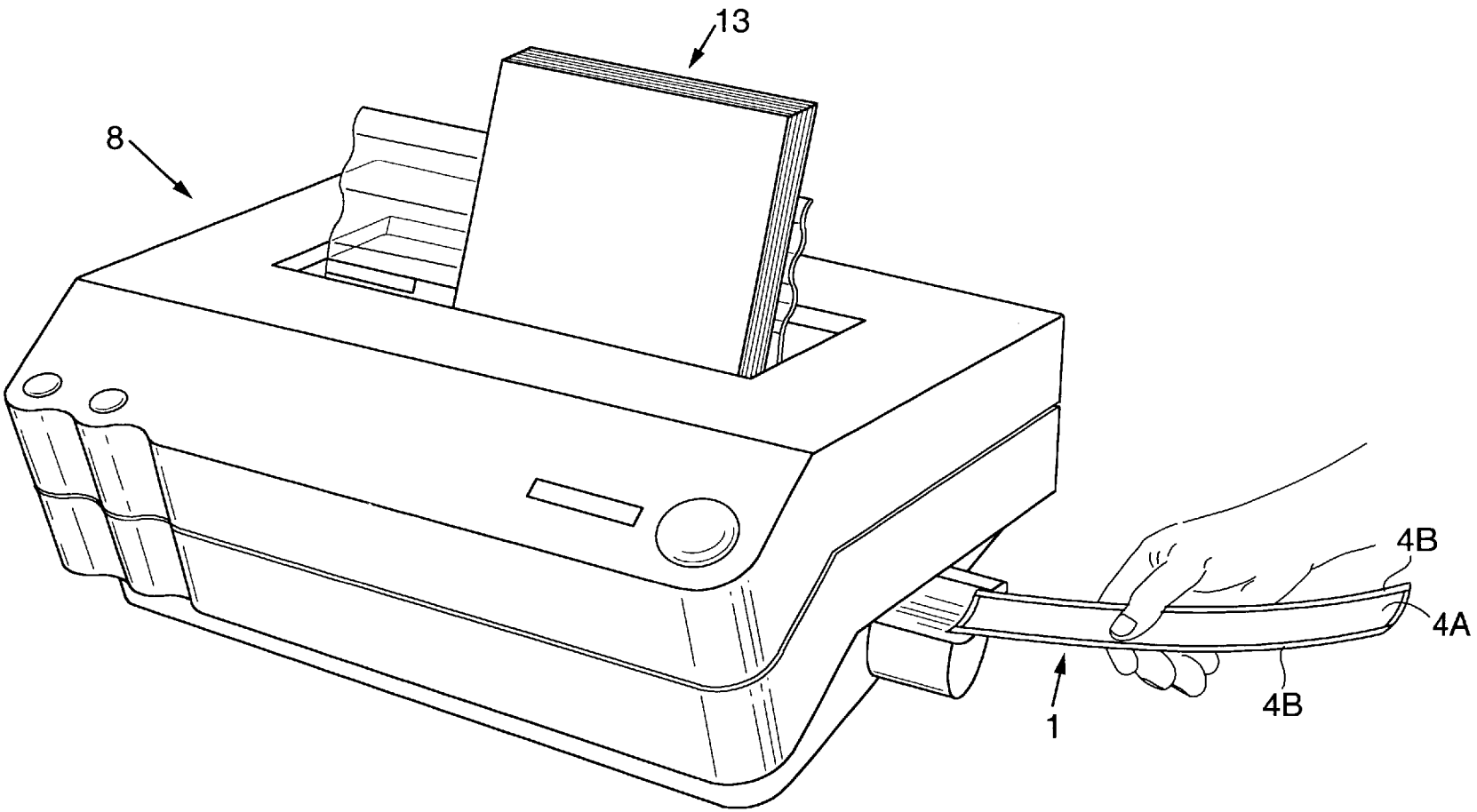
FIG. 2 (PRIOR ART)
FIG. 2 shows the prior art bookbinding structure of FIGS. 1A, 1B or 1C being inserted into a conventional binding machine to bind the pages.
Figure 3A:
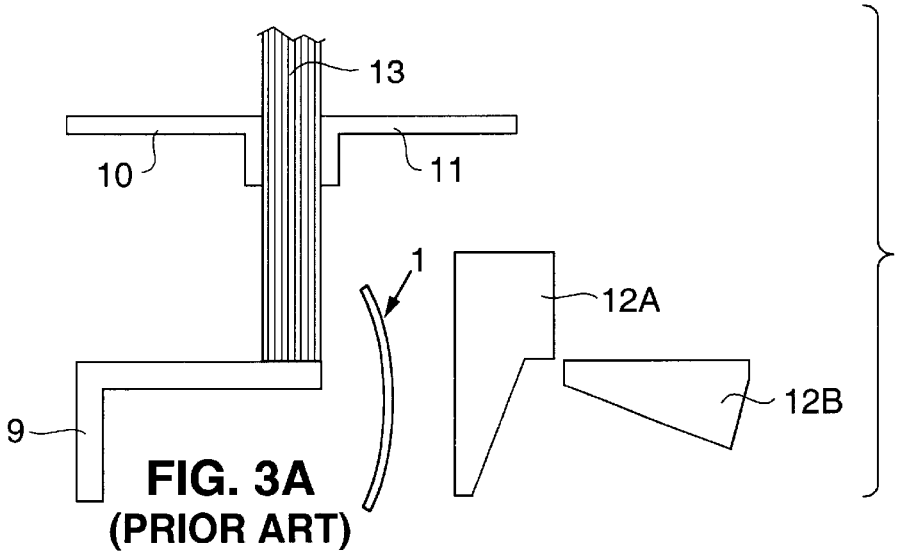
FIG. 3A (PRIOR ART)
FIGS. 3A–3E show the sequence of binding a stack using the prior art bookbinding structures of FIGS. 1A, 1B or 1C and the binding machine of FIG. 2.
Figure 3B:
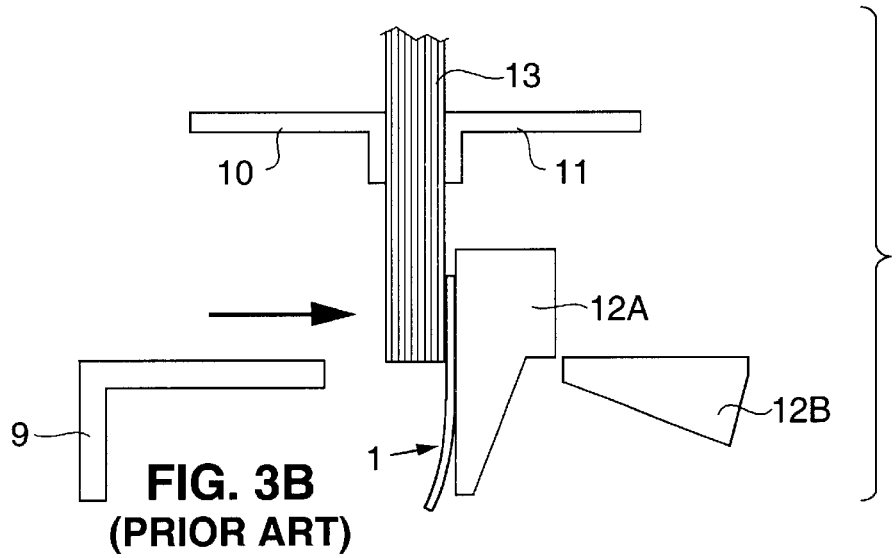
FIG. 3B (PRIOR ART)
Figure 3C:
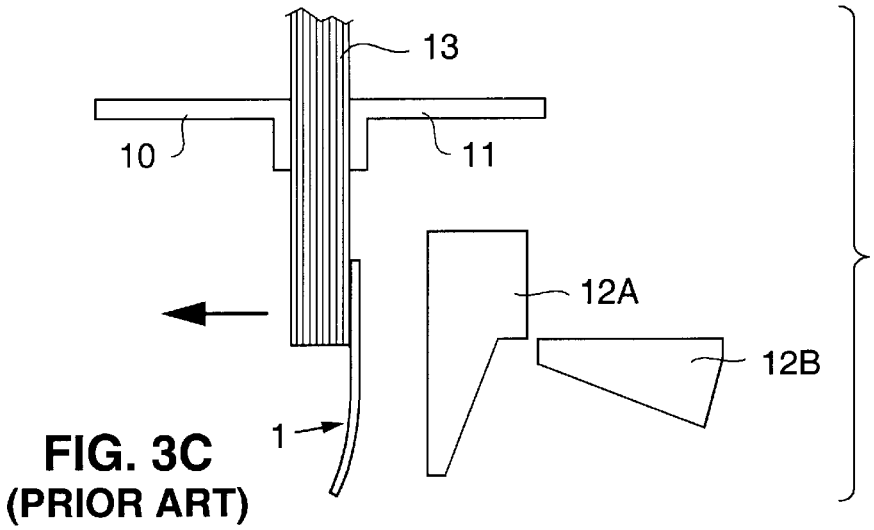
FIG. 3C (PRIOR ART)
Figure 3D:
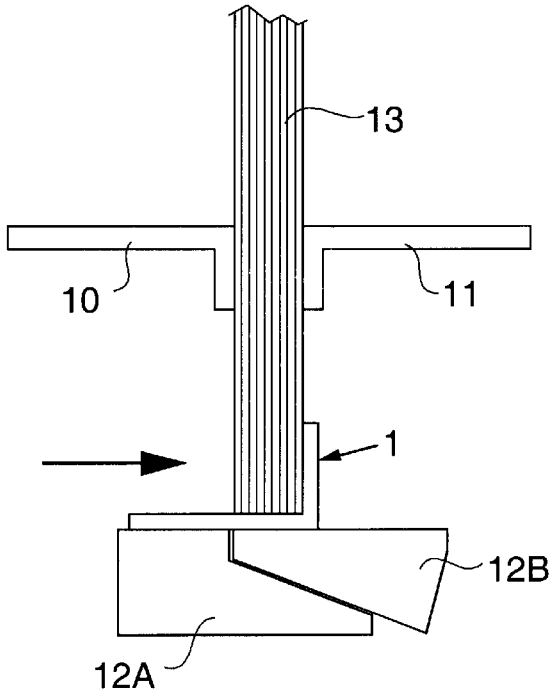
FIG. 3D (PRIOR ART)
Figure 3E:
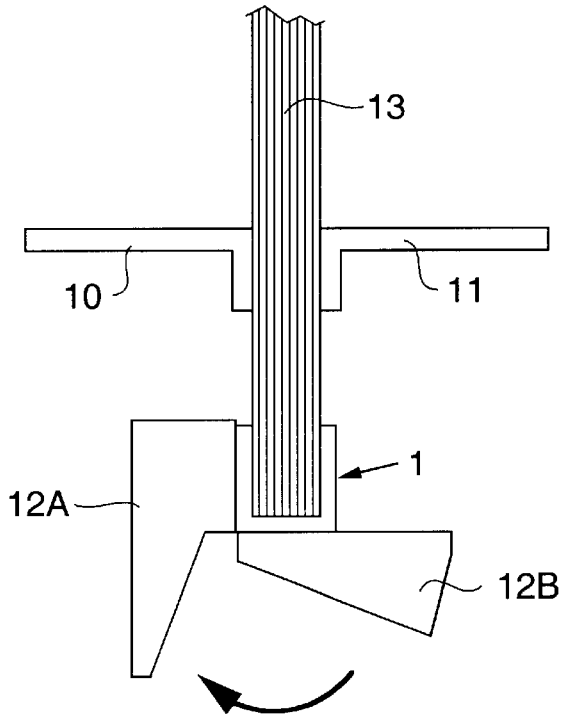
FIG. 3E (PRIOR ART)

As previously noted, in some cases it would be desirable to minimize the number of bookbinding structures needed to bind stacks of varying thickness. Machine 2 of FIG. 2 is implemented to position a conventional binder strip so that the strip is centered on the spine of the stack. However, since the bookbinding structure 18 is largely not visible, it possible to fix the location that the adhesive strip 22A is positioned relative to the spine of the stack 30 and to permit the position of the remaining strip 22B to vary depending upon the actual thickness of the stack 30. Since the location of strip 22A will be fixed, the approximate location in which the first page of the stack 30 is secured to the front cover will be at a fixed, optimum location. This optimum, and therefore attractive, location is something that a reader of the bound book will most likely notice when the book is opened during use. The fact that the location at which the last page of the stack is secured to the rear cover section 22B may move, depending upon the thickness of the stack 30, is less critical since this location is less noticeable during normal use of the book. Machine 8 (FIG. 2) can be readily modified by way of software changes so that location that the structure (see relative position of strip 1 and stack 13 of FIG. 3C) is first applied to the bound stack will be fixed and will not be changed, as is the normal case, depending upon the thickness of the stack.

Figure 19:
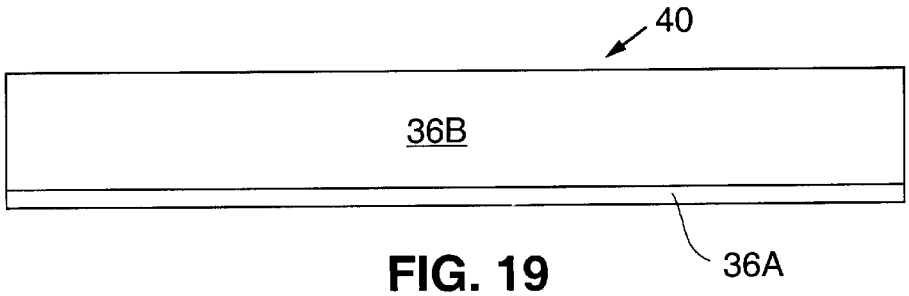
FIG. 19 is a bottom view of the second embodiment book binding structure showing the two release liners of the structure.
Figure 20:
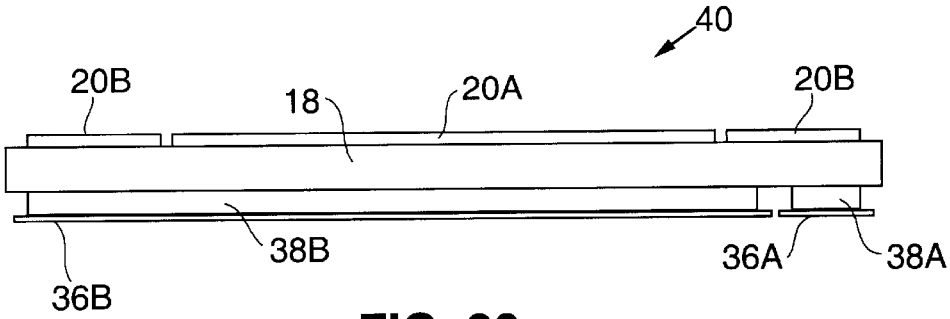
FIG. 20 is an end elevational view of the second embodiment bookbinding structure.

A second embodiment 40 of the subject bookbinding structure is shown in FIG. 20. Embodiment 40 allows the cover assembly to be easily secured to a bound stack 30. However, this embodiment does not provide the so-called lay flat feature of the first embodiment structure 16. The second embodiment structure includes a substrate 18 and heat activated adhesive bands 20A and 20B disposed on what will be the inner surface of the substrate. Bands 20A and 20B are similar in construction, composition and function to the bands 20A and 20B of the first embodiment structure. A narrow pressure activated adhesive band 38A is disposed along one edge of the substrate 18 along what will be the outer surface of the substrate, with substantially all of the remaining outer surface of the substrate 18 being covered by a separate layer or band of pressure activated adhesive 38B. As can also be seen in FIG. 19, all of adhesive band 38A is covered by a release liner 36A and all of adhesive band 38B is covered by a second release liner 36B. As long a separate release liners 36A and 36B are used, it would be possible to replace adhesive layers 38A and 38B with a single continuous layer. However, the use of separate adhesive layers facilitates separate removal of release liners 36A and 36B. Also, although not shown in FIG. 20, in order to ensure that none of the pressure sensitive adhesive 38A/38B is exposed during binding, it is preferred that there be a slight overlap of liners 36A and 36B.

Figure 18:
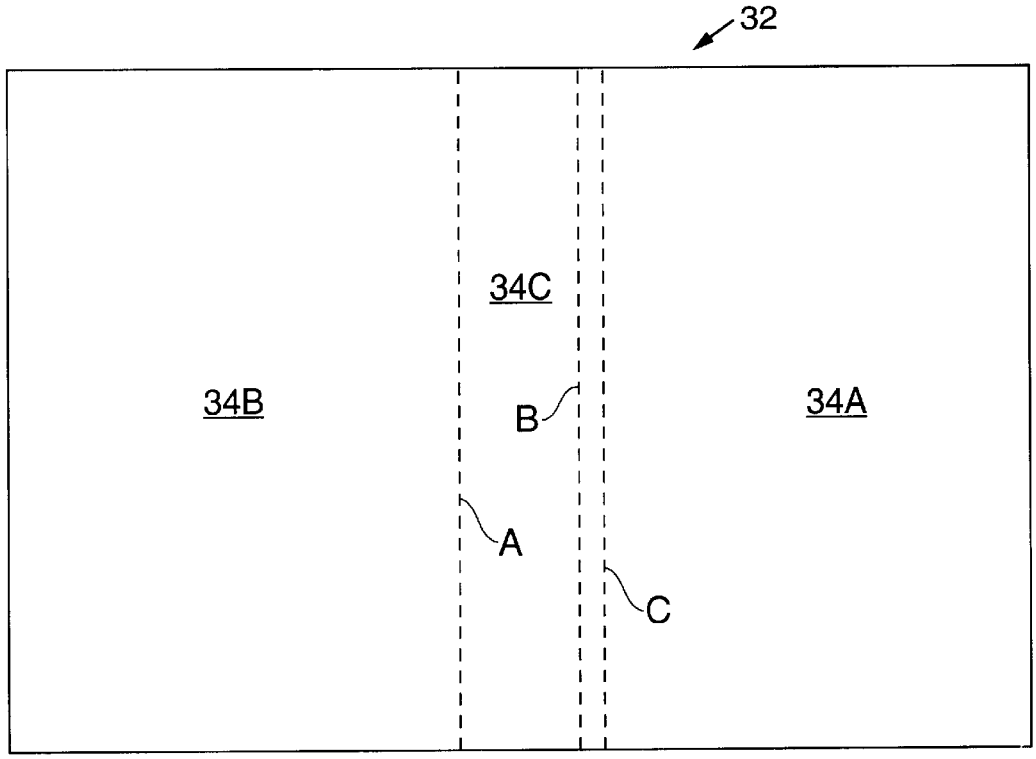
FIG. 18 is a plan view of a cover assembly for use with a second embodiment book binding structure.

The second embodiment bookbinding structure 40 is used to bind a stack 30 in the same manner as the first embodiment 16. Once the stack 30 has been bound, the narrow release liner 36A is removed, thereby exposing the underlying pressure activated band 28A. A preprinted cover assembly 32 is then pre-scored along score or crease lines A, B and C as shown in FIG. 18. The spacing between score lines A and B is selected to match the thickness of the stack 30. Score line C is located on the front cover section 34A of the cover assembly and is present so as to facilitate opening of the front cover and to enhance the appearance of the book.

Figure 21:
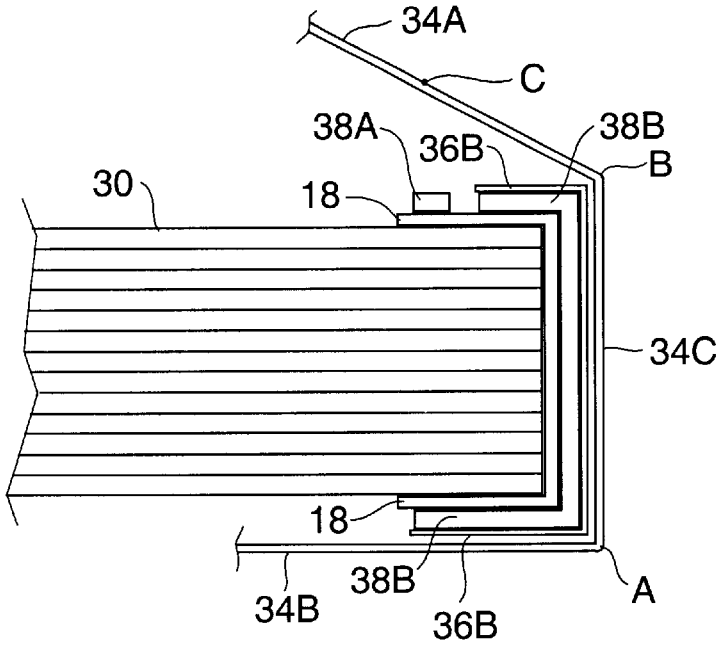
FIG. 21 is a elevational sectional view of the FIG. 20 bookbinding structure with one of the release liners removed and with the cover assembly being folded around the bound book.

The steps from securing the bound stack 30 to the cover assembly are substantially the same as carried out in connection with the first embodiment as illustrated in FIGS. 16A–16F. First, the user folds the cover assembly along the pre-scored lines A, B and C (FIG. 16A). Next, the user manually removes release liner 36A (FIG. 16B), as noted above. The stack 30 is then positioned between the front and rear cover sections 34A and 34B (FIG. 16C), as shown in FIG. 21. Again, since only narrow adhesive band 38A is exposed and layer 38B is covered, there will be no tendency for the cover assembly to adhere to the stack until the user applies pressure to the front cover section 34A in the region near band 38A. Thus, the user is free the reposition the stack 30 with respect to the cover assembly to achieve the desired orientation.

Figure 4:
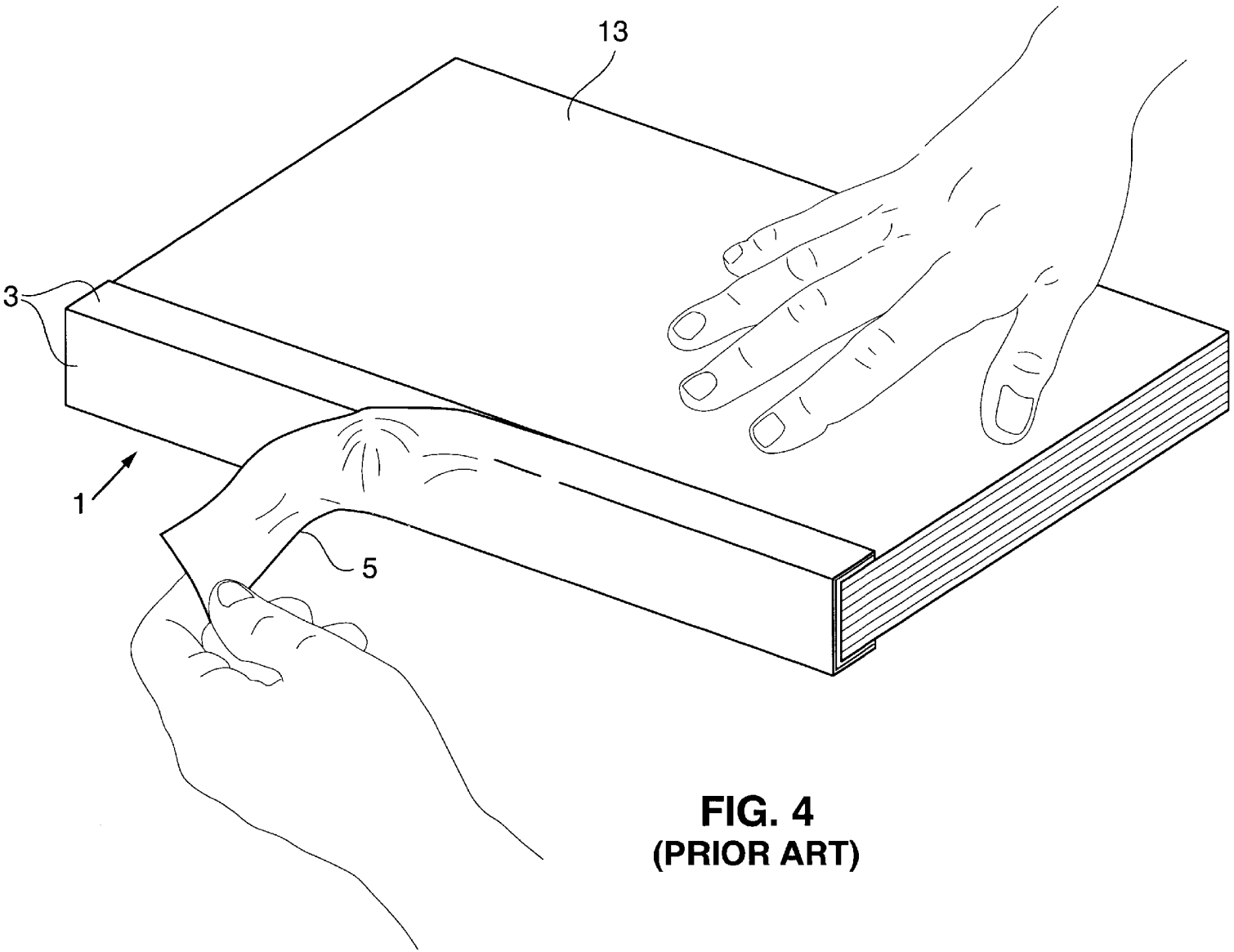
FIG. 4 (PRIOR ART)
FIG. 4 shows the release liner being peeled away from the pressure activated adhesive of the FIG. 1A bookbinding structure after the book has been bound.
Figure 5:
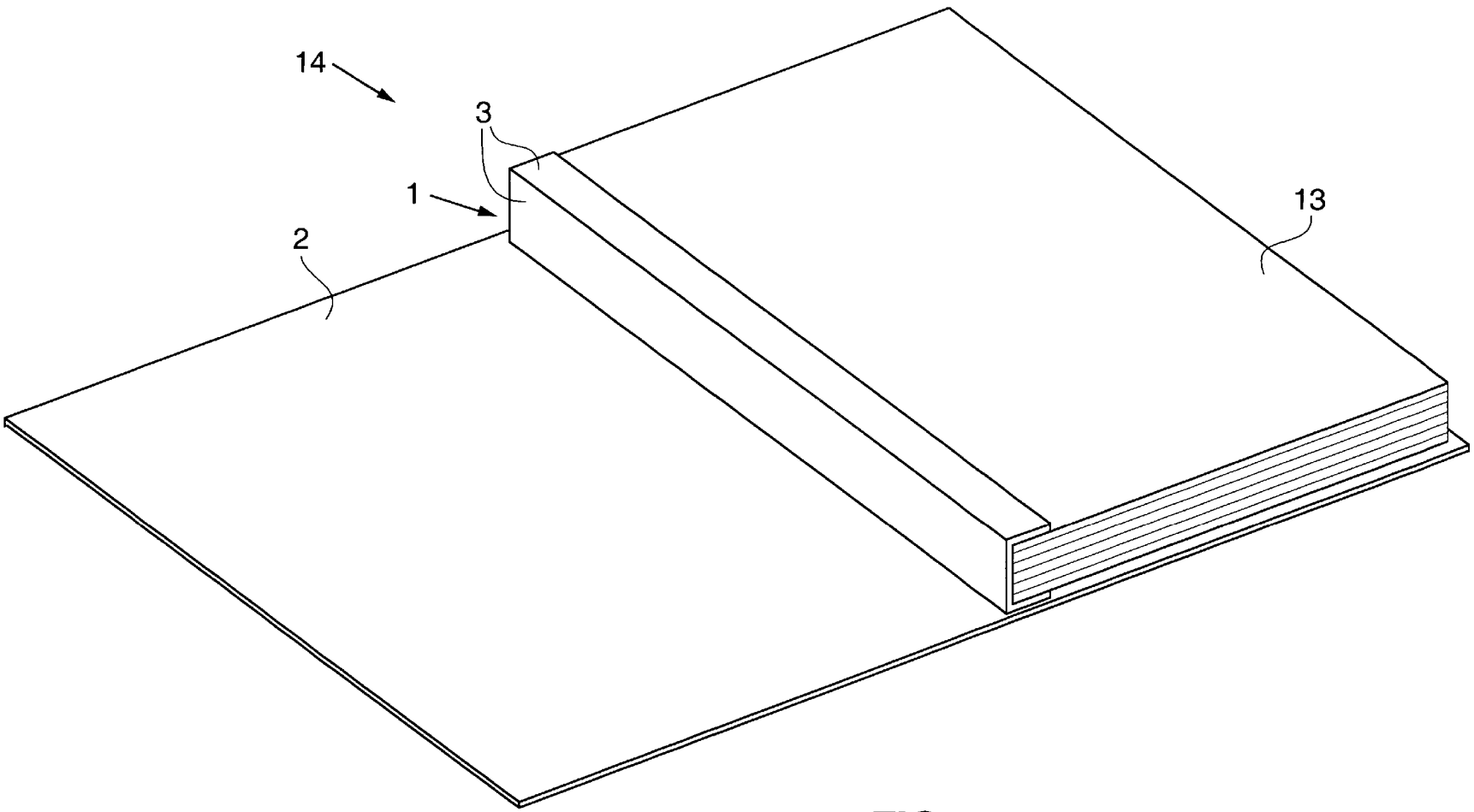
FIG. 5 (PRIOR ART)
FIG. 5 is a perspective view of the bound book positioned on a wrap-around book cover prior to folding of the cover.
Figure 6:
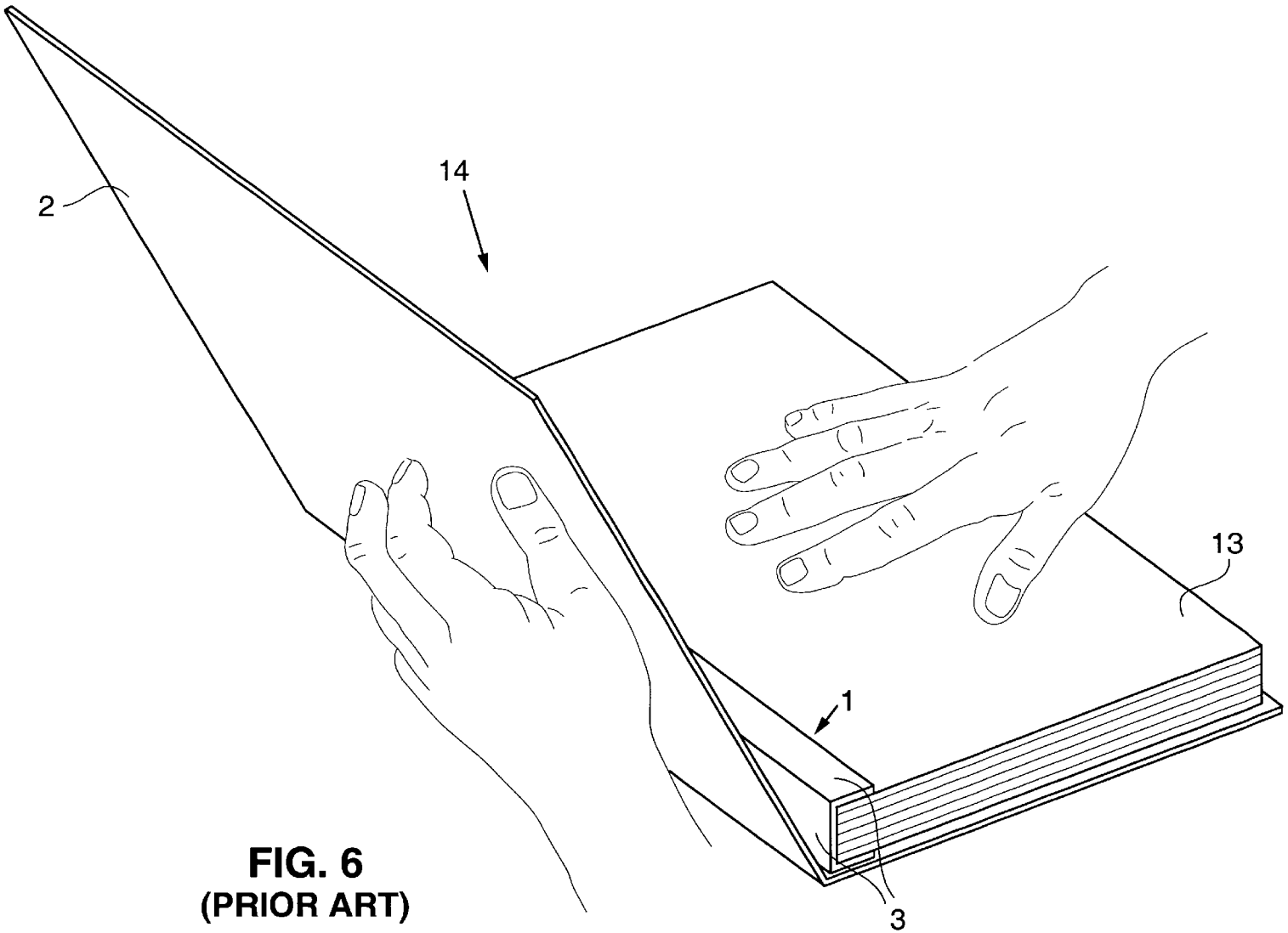
FIG. 6 (PRIOR ART)
FIG. 6 shows the wrap around book cover being folded over the book and adhered to the pressure activated adhesive of the FIG. 1A bookbinding structure.
Figure 7:
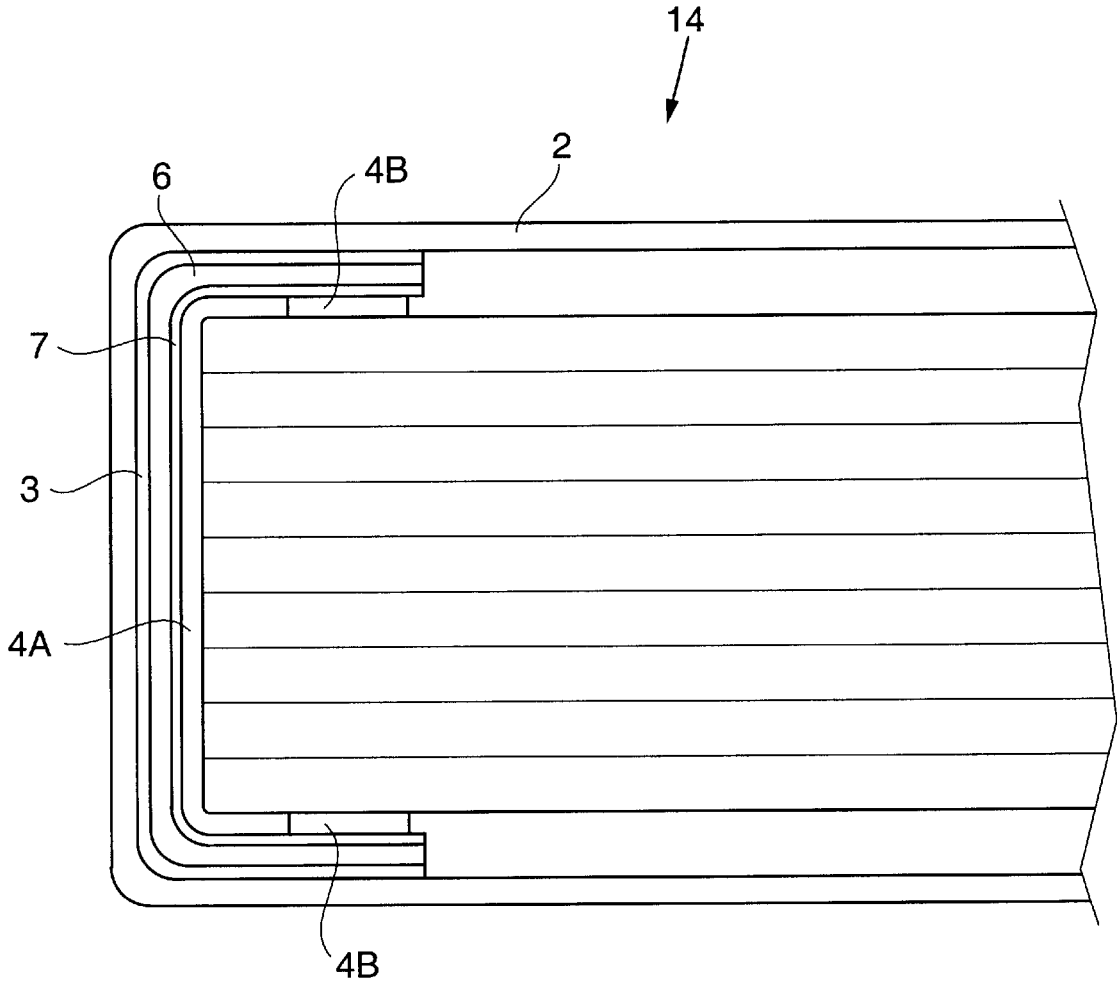
FIG. 7 (PRIOR ART)
FIG. 7 is an end view of the covered book bound with the FIG. 1A bookbinding structure.
Figure 8A:
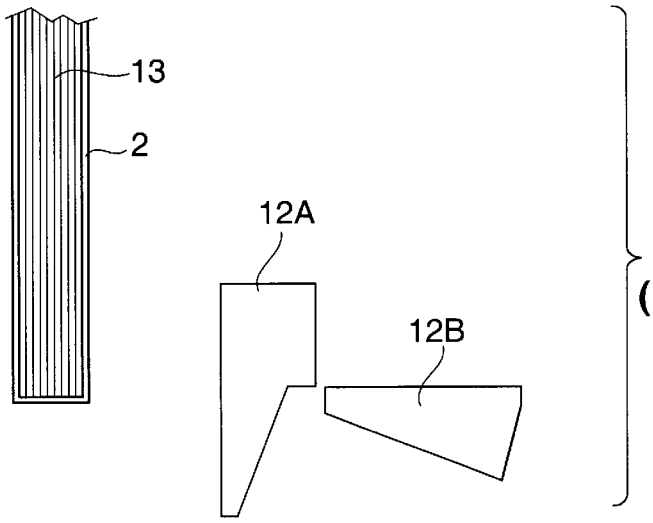
FIG. 8A (PRIOR ART)
FIGS. 8A through 8E show the sequence for attaching the cover to the bound stack using the FIG. 2A bookbinding structure where the FIG. 2 binding machine is used to activate the adhesive used to attach the cover.
Figure 8B:
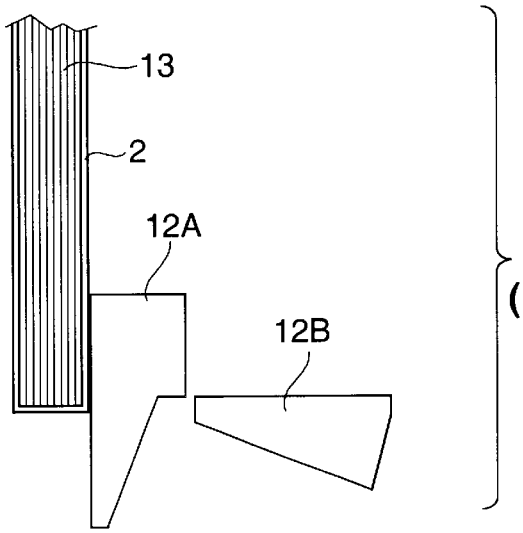
FIG. 8B (PRIOR ART)
Figure 8C:
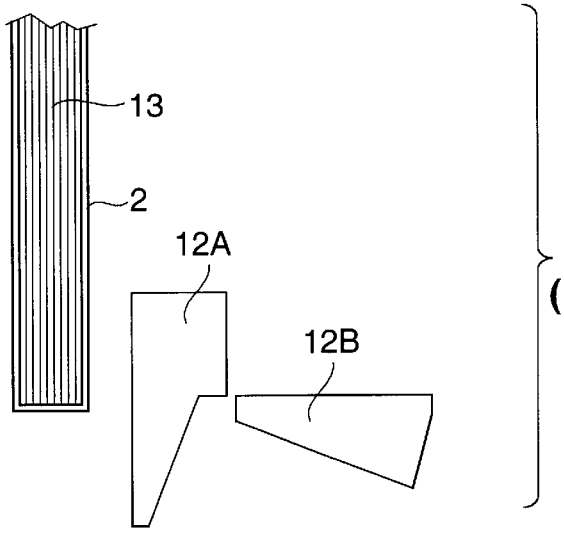
FIG. 8C (PRIOR ART)
Figure 8D:
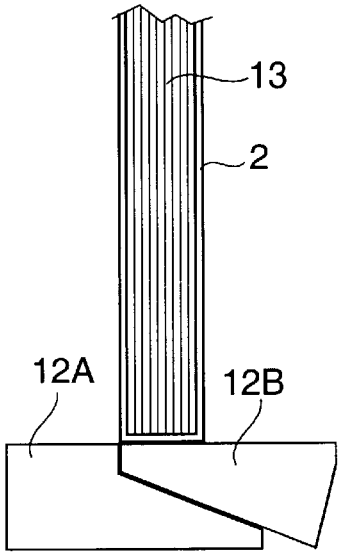
Figure 8E:
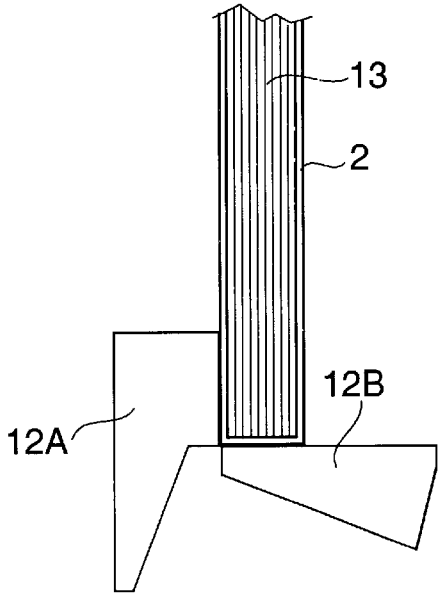
Figure 9A:
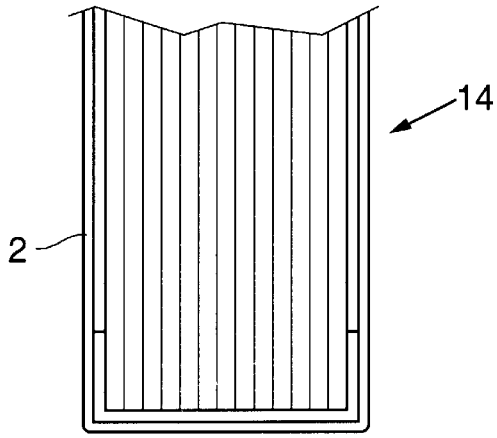
FIG. 9A (PRIOR ART)
FIG. 9A is an end view of a bound book having a wrap-around book cover which extends over the front, back and spine of the book.
Figure 9B:
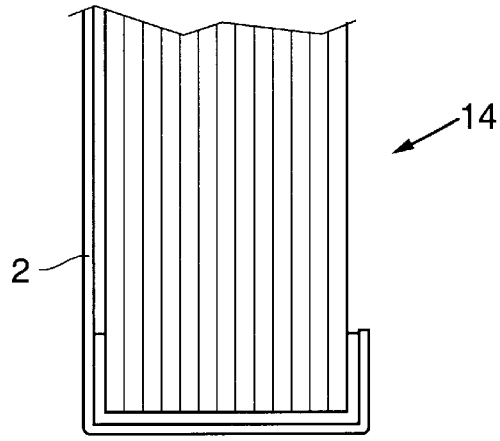
FIG. 9B (PRIOR ART)
FIG. 9B is an end view of a bound book having a wrap-around book cover which extends over the spine, the front and a small portion of the rear of the book.
Figure 9C:
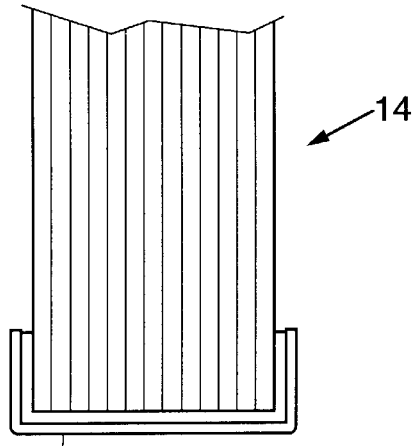
FIG. 9C (PRIOR ART)
FIG. 9C is an end view of a bound book having a cover which extends over the spine and a small portion of the front and rear of the book.
Figure 22:
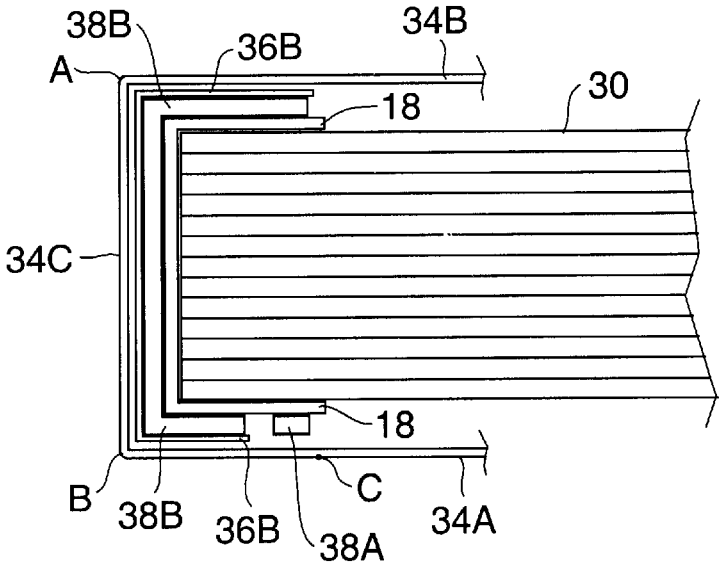
FIG. 22 is an elevational sectional view of the FIG. 20 bookbinding structure after the cover assembly has been folded around the book with one of the release liners removed and with the second release liner in place.
Figure 23:
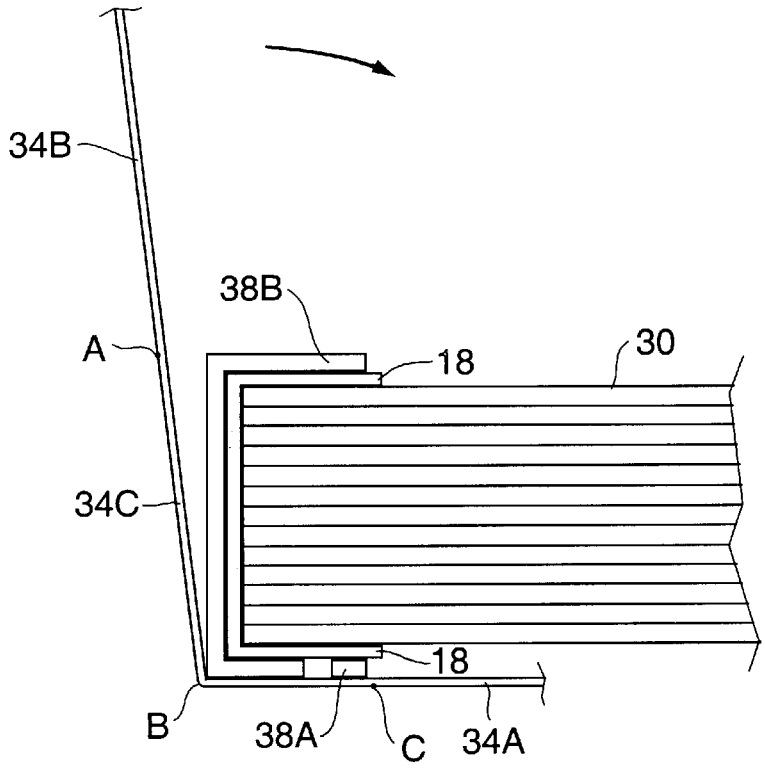
FIG. 23 is an elevational sectional view of the FIG. 20 bookbinding structure after the cover assembly has been manually forced against one side of the bound book so as to secure the assembly at that location and with the second release liner removed so that the remainder of the assembly can be folded back around the bound book so as to secure the remainder to the cover assembly to the book.
Figure 24:
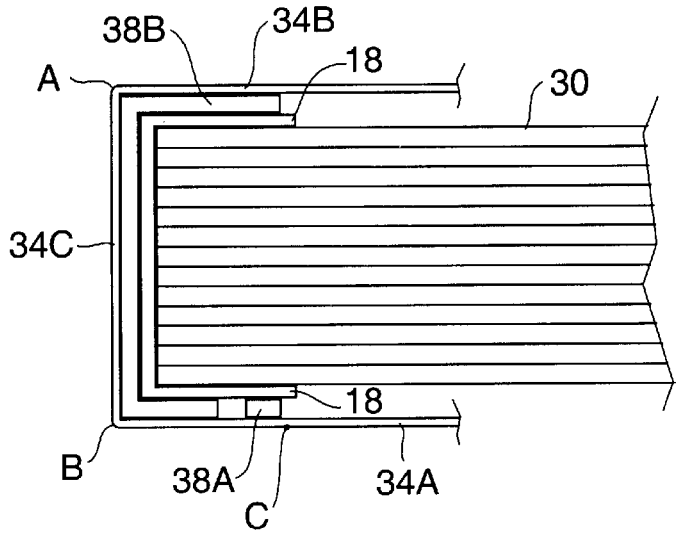
FIG. 24 is an elevational sectional view of the FIG. 20 bookbinding structure showing the bound book after both sides of the book having been secured to the cover assembly.

Once the user achieves the desired position, pressure is applied to the front cover assembly 34A thereby securing the cover assembly to the stack 30 (FIG. 16D). The next step is to remove the second release liner 36B so as to expose pressure activated layer 38B (16E). One way to carry out this step is to reposition the stack 30 and cover assembly 32 as shown in FIG. 22 with the attached cover section 34A on the bottom (Note that FIG. 22 does not show adhesive band 38A contacting the cover section 34A to simplify illustrating the structure, although the band is contacting the cover section at this point.) The user then folds back the back cover section 34B and the spine cover section 34C to expose as most of the second release liner 36B. The user then manually removes the release liner in much the same way liner 5 is removed as shown in FIG. 4. The user then folds the rear cover section 34B and spine section 34C back over the exposed adhesive layer 38B. Pressure is then applied to full length of the spine section 34C and to the rear cover section 34B in the region of the pressure activated layer 38B, thereby completing the binding sequence (FIG. 16F). The final bound book is shown in FIG. 24. A reader can then open the book, with the front cover section 34A folding along score C, with score C being located so that it is approximately aligned with the edge of substrate 18.

Thus, a novel bookbinding structure has been disclosed which permits a stack of pages to be easily bound which provides a mass produced appearance but using only desk top equipment. Although two embodiments of the structure have been described in some detail, it is to be understood that certain changes can be made by those skilled in the art without departing from the spirit and scope of the invention as defined by the appended claims. By way of example, release liners 36A and 36B can be part of a common release liner, separated by perforations or the like so that the liners can be removed or peeled away separately by the user. In that case, the liners are considered to be separate liners in the present application. Further, it is preferred that the portion of the outer surface of the substrate 18 which will eventually be disposed between lines X and Y in the first embodiment or between lines A and B in the second embodiment either be free of pressure activated adhesive of be covered by a release liner prior to the application of the cover assembly to the bound stack in order to facilitate attaching the cover assembly to the stack.

What is claimed is:

1. A bookbinding structure for binding a stack of sheets, with the stack of sheets having a thickness, a width and a length, said structure comprising:

an elongated substrate having a length that generally corresponds to the length of the stack and a width greater than the thickness of the stack;

a first heat activated adhesive matrix disposed on a first surface of the substrate;

a second pressure activated adhesive matrix disposed on a second surface of the substrate, opposite the first surface, with the pressure activated adhesive matrix including a first segment that extends substantially along the full length of the substrate and a second segment that extends substantially along the full length of the substrate;

a first release liner disposed over the first segment of the pressure activated adhesive matrix; and a second release liner, separate from the first release liner, disposed over the second segment of the pressure activated adhesive matrix.

2. The bookbinding structure of claim 1 wherein the first segment of the pressure activated adhesive matrix is disposed exclusively in a first region of the second substrate surface starting at a first edge of the substrate and extending towards a second edge of the substrate, opposite the first edge, equal to a distance of no more than one-quarter a width of the substrate, with only the pressure activated adhesive in the first segment being exposed when said first release liner is separated from the bookbinding structure.

3. The bookbinding structure of claim 2 wherein the second segment of the pressure activated adhesive matrix is disposed exclusively in a second region of the second substrate surface starting at the second edge of the substrate and extending towards the first edge of the substrate a distance of no more than one-quarter of the width of the substrate, with only the pressure activated adhesive in the second segment being exposed when said second release liner is separated from the bookbinding structure.

4. The bookbinding structure of claim 2 wherein the second segment of the pressure activated adhesive matrix is disposed in a second region of the second substrate surface starting at the second edge of the substrate and extending towards the first edge of the substrate a distance of at least one-half of the width of the substrate, with only the pressure activated adhesive in the second segment being exposed when said second release liner is separated from the bookbinding structure.

5. The bookbinding structure of claim 1 wherein the first release liner is disposed exclusively over a first region of the second substrate surface starting at a first edge of the substrate and extending towards a second edge of the substrate, opposite the first edge, equal to a distance of no more than one-quarter a width of the substrate.

6. The bookbinding structure of claim 5 wherein the second release liner is disposed exclusively over a second region of the second substrate surface starting at the second edge of the substrate and extending towards the first edge of the substrate a distance of no more than one-quarter of the width of the substrate.

7. The bookbinding structure of claim 5 wherein the second release liner is disposed over a second region of the second substrate surface starting at the second edge of the substrate and extending towards the first edge of the substrate a distance of at least one-half of the width of the substrate.

8. A bookbinding structure for binding a stack of sheets comprising:

an elongated substrate which includes a first surface which includes a center portion which is disposed opposite an edge of the stack after application of the substrate to the stack, a first portion which is disposed opposite a first side of the stack after application of the substrate to the stack and a second portion which is disposed opposite a second side of the stack after application of the substrate to the stack;

a first adhesive matrix disposed over a second surface of the substrate, opposite the first surface, for securing the substrate to the edge of the stack;

a second pressure activated adhesive matrix disposed over at least the first and second portions of the first surface of the substrate;

a first release liner disposed over the first surface of the substrate such that, upon removal of the first release liner, only that portion of the pressure activated adhesive matrix disposed over the first portion of the first substrate surface is exposed.

9. The bookbinding structure of claim 8 further including a second release liner disposed over at least the second portion of the first surface of the substrate.

10. The bookbinding structure of claim 9 wherein the second pressure activated adhesive is disposed over at least a part of the center portion of the first surface and wherein the second release liner is disposed over at least the part of the center portion of the first surface of the substrate.

11. A method of forming a bound book using a bookbinding structure which includes a substrate having first adhesive matrix disposed on a first surface of the substrate and a second, pressure activated, adhesive matrix disposed on a second surface, opposite the first surface, of the substrate, said method comprising:

applying the bookbinding structure to an edge of a stack of pages to be bound so that the substrate is secured to the edge by way of the first adhesive matrix so as to form a bound stack;

after said applying, exposing only a first portion of the second adhesive matrix;

securing a first portion of a cover assembly to the bound stack by way of the only the first portion of the second adhesive matrix; and subsequent to the securing, exposing at least a further portion of the second adhesive matrix; and securing a second portion of the cover assembly to the bound stack by way of the at least a further portion of the second adhesive matrix.

12. The method of claim 11 wherein the cover assembly includes a first cover section, a second cover section and a spine section intermediate the first and second cover sections, with the spine section being positioned facing the edge of the stack after the applying the bookbinding structure to an edge of the stack and wherein the first portion of the cover assembly is limited to within the first cover section of the cover assembly.

13. The method of claim 12 wherein the second portion of the cover assembly is limited to within the second cover section of the cover assembly.

14. The method of claim 12 wherein the second portion of the cover assembly includes at least part of the second cover section and the spine section of the cover assembly.

15. The method of claim 11 wherein the first adhesive matrix includes a heat activated adhesive and wherein the applying the bookbinding structure to an edge of the stack includes applying heat and pressure.

16. The method of claim 15 wherein the cover assembly includes a first cover section, a second cover section and a spine section intermediate the first and second cover sections, with the spine section being positioned facing the edge of the stack after the applying the bookbinding structure and wherein no portion of the second adhesive matrix opposite the spine section of the cover assembly is exposed in the exposing at least a further portion of the second adhesive matrix.

17. A method of forming a bound book using a bookbinding structure which includes a substrate having first adhesive matrix disposed on a first surface of the substrate and a second, pressure activated, adhesive matrix disposed on a second surface, opposite the first surface of the substrate, a first release liner disposed over a first portion of the second adhesive matrix and a second release liner exposed over a second portion of the second adhesive matrix, said method comprising:

applying the bookbinding structure to an edge of a stack of pages to be bound so that the substrate is secured to the edge by way of the first adhesive matrix so as to form a bound stack;

separating the first release liner from the bookbinding structure so as to expose the first portion of the second adhesive matrix;

separating the second release liner from the bookbinding structure so as to expose the second portion of the second adhesive matrix;

securing a first portion of a cover assembly to the bound stack by way of the first portion of the second adhesive matrix; and.

securing a second portion of the cover assembly to the bound stack by way of the second portion of the second adhesive matrix.

18. The method of claim 17 wherein said separating the first release liner takes place subsequent to the applying the bookbinding structure.

19. The method of claim 18 wherein said separating the second release liner takes place subsequent to said securing a first portion.

20. The method of claim 17 wherein the first adhesive matrix includes a heat activated matrix and wherein the applying the bookbinding structure includes applying heat and pressure to the bookbinding structure.

21. The method of claim 20 wherein said separating the first release liner takes place subsequent to the applying the bookbinding structure.

22. The method of claim 21 wherein said separating the second release liner takes place subsequent to said securing a first portion.

23. A bound book comprising:

a stack of sheets having an edge to be bound and including first and second cover sheets on opposite sides of the stack;

an elongated substrate having a length that generally corresponds to a length of the stack of sheets, with the elongated substrate being secured to the edge of the stack of sheets opposite a spine section of the elongated substrate by way of a heat activated adhesive, with the spine section being disposed intermediate first and second substrate cover sections that extend over the first and second respective cover sheets;

a pressure activated adhesive matrix disposed on a surface of the elongated substrate opposite a surface on which the heat activated adhesive is disposed, with said pressure activated adhesive matrix being disposed along at least the first and second substrate cover sections;

a first release liner disposed over the pressure activated adhesive exclusively along the first substrate cover section;

a second release liner, separate from the first release liner, disposed over at least the second substrate cover section.

24. The bound book of claim 23 wherein the pressure activated adhesive is also disposed along the substrate spine section and wherein the second release liner is disposed over the pressure activated adhesive on the second substrate cover section and the substrate spine section.

25. The bound book of claim 23 wherein the second release liner is disposed exclusively along the second substrate cover section.

* * * * *

UNITED STATES PATENT AND TRADEMARK OFFICE

CERTIFICATE OF CORRECTION

PATENT NO. : 6,709,727 B1
DATED : March 23, 2004
INVENTOR(S) : Kevin P. Parker

It is certified that error appears in the above-identified patent and that said Letters Patent is hereby corrected as shown below:

Title page,Item [57], ABSTRACT, line 18,
"positioned the stack with in" should be deleted and replaced with
-- position the stack within --.

In Column 1, line 7, "rally" should be deleted and replaced with --generally--.

In Column 1, line 15, "use a heat" should be deleted and replaced with --use heat--.

In Column 3, line 28, "May 15,00" should be deleted and replaced with --May 15, 2000--.

In Column 5, line 6, "fulling" should be should be deleted and replaced with --fully--.

In Column 8, line 20, "it typically first manually removed, typically be" should be deleted and replaced with --is typically first manually removed, typically by--.

In Column 8, line 33, "there by" should be deleted and replaced with --thereby--.

In Column 9, line 38, "having" should be deleted and replaced with --have--.

In Column 10, line 3, "having" should be deleted and replaced with --have--.

In Column 10, line 49, "shown FIG. 2" should be deleted and replaced with --shown in FIG. 2--.

In Column 11, line 54, "cover assembly is attached to the cover assembly" should be deleted and replaced with --cover assembly is attached to the substrate 18--.

In Column 12, line 9, "know" should be deleted and replaced with --known--.

In Column 12, line 33, "that location that" should be deleted and replaced with --that the location where--.

In Column 12, line 56, "As long a" should be deleted and replaced with --As long as--.

In Column 13, line 20, "free the reposition" should be deleted and replaced with --free to reposition--.

In Column 13, line 34, "expose as most" should be deleted and replaced with --expose most--.

In Column 13, line 64, "adhesive of" should be deleted and replaced with --adhesive or--.

In Column 16, line 31, "matrix; and." should be deleted and replaced with --matrix; and-- without the period mark.

Signed and Sealed this

Eighth Day of June, 2004

JON W. DUDAS
*Acting Director of the United States Patent and Trademark Office*